US011493035B2

(12) United States Patent
Crawford et al.

(10) Patent No.: US 11,493,035 B2
(45) Date of Patent: Nov. 8, 2022

(54) HIGH PRESSURE PUMPING SYSTEM

(71) Applicant: Viking Pump, Inc., Cedar Falls, IA (US)

(72) Inventors: Michael R. Crawford, Cedar Falls, IA (US); Andrew Anderson, Waterloo, IA (US); Josh Gerbig, Cedar Falls, IA (US); Scott Meyer, Brandon, IA (US); Cameron Neff, Waterloo, IA (US); Justin Pierce, Dunkerton, IA (US)

(73) Assignee: Viking Pump, Inc., Cedar Falls, IA (US)

( * ) Notice: Subject to any disclaimer, the term of this patent is extended or adjusted under 35 U.S.C. 154(b) by 38 days.

(21) Appl. No.: 16/993,907

(22) Filed: Aug. 14, 2020

(65) Prior Publication Data

US 2021/0048023 A1 Feb. 18, 2021

Related U.S. Application Data

(60) Provisional application No. 62/886,547, filed on Aug. 14, 2019.

(51) Int. Cl.
*F03C 2/00* (2006.01)
*F03C 4/00* (2006.01)
(Continued)

(52) U.S. Cl.
CPC ..... *F04C 2/18* (2013.01); *F04C 11/001* (2013.01); *F04C 15/0003* (2013.01); *F04C 15/0057* (2013.01); *F04C 2240/56* (2013.01)

(58) Field of Classification Search
CPC ..... F04C 2/086; F04C 2/18; F04C 11/001; F04C 15/0003; F04C 15/0023;
(Continued)

(56) References Cited

U.S. PATENT DOCUMENTS 2,809,592 A * 10/1957 Miller ..... F04C 15/0026 418/132
4,830,592 A * 5/1989 Weidhaas ..... F04C 15/0026 418/132
(Continued)

FOREIGN PATENT DOCUMENTS

CN 108194349 A 6/2018
DE 202006012409 U1 * 10/2006 ..... F04C 2/086
(Continued)

OTHER PUBLICATIONS

The International Search Report and the Written Opinion of the International Searching Authority for corresponding PCT patent application PCT/US2020/046423, dated Nov. 24, 2020, 19 pages.

*Primary Examiner* — Theresa Trieu

(74) *Attorney, Agent, or Firm* — Tucker Ellis LLP; Michael G. Craig; Heather M. Barnes

(57) ABSTRACT

A pump technology that provides for more effective and efficient transfer of liquids, such as petroleum products and components, to and through pipelines. Such a technology can comprise a type of external gear pump that creates higher flow, resulting in higher pressures in the pipeline, to move the liquids, while providing for longer pump life, simpler and less maintenance, and fewer undesired conditions, with a smaller footprint, in a cost-effective system. Further, one or more portions of the pump can be configured to be easily replaceable to provide for maintenance in place, and provide for longer pump life. Additionally, one or more portions of the pump can be constructed with or coated with
(Continued)

abrasive resistant material that extends the life of the external gear pump. Such material can also reduce the friction between surfaces and improve the life of the external gear pump under poor feeding conditions.

18 Claims, 32 Drawing Sheets

(51) Int. Cl.

| | |
|---|---|
| ***F04C 2/00*** | (2006.01) |
| ***F04C 18/00*** | (2006.01) |
| ***F04C 2/18*** | (2006.01) |
| ***F04C 11/00*** | (2006.01) |
| ***F04C 15/00*** | (2006.01) |

(58) Field of Classification Search
CPC ..... F04C 15/0057; F04C 2240/54; F04C 2240/56; F04C 2240/70; F04C 2240/801; F04C 2240/802; F01C 21/02; F01C 21/10; F16C 33/1025; F16C 33/103; F16C 33/1045; F16C 33/105; F16C 33/106; F16C 33/1065; F16C 33/1085; F16C 17/02; F16C 17/10
See application file for complete search history.

(56) References Cited

U.S. PATENT DOCUMENTS

| | | | | |
|---|---|---|---|---|
| 5,120,206 | A * | 6/1992 | Greenstreet | F04C 15/0026 418/102 |
| 6,390,793 | B1 * | 5/2002 | Sweet | F04C 15/0026 418/132 |
| 11,204,032 | B2 * | 12/2021 | Meyer | F04C 15/0003 |
| 2002/0159906 | A1 * | 10/2002 | Phallen | F04C 15/0026 418/132 |
| 2003/0194342 | A1 * | 10/2003 | Bhagavatula | F04C 15/0046 418/132 |
| 2006/0051230 | A1 | 3/2006 | Jordan | |
| 2008/0240968 | A1 * | 10/2008 | Chiu | F04C 2/18 418/206.7 |
| 2009/0123320 | A1 * | 5/2009 | Jordan | F04C 15/0026 418/270 |
| 2009/0297384 | A1 * | 12/2009 | Seabolt | F04C 2/18 418/206.5 |
| 2010/0202913 | A1 | 8/2010 | Shimamura | |

FOREIGN PATENT DOCUMENTS

| | | | | |
|---|---|---|---|---|
| DE | 102006013111 | A1 | 11/2007 | |
| JP | 09209729 | A * | 8/1997 | F16C 33/1085 |

* cited by examiner a

HIGH PRESSURE PUMPING SYSTEM

CROSS-REFERENCE TO RELATED APPLICATIONS

This application claims priority to U.S. Provisional Patent Application Ser. No. 62/886,547, entitled HIGH PRESSURE PUMPING SYSTEM, filed Aug. 14, 2019, which is incorporated herein by reference.

BACKGROUND

Crude oil and other petroleum products and components can be transported using a pipeline, for example, from an oilfield to storage facilities and refineries. A pump may be used to help move the liquids from the oilfields to the pipeline and through the pipeline to the storage facilities and refineries. Various types of pumps can be used; the types, power, and size may be dependent on the type of liquid, distance, characteristics, and/or pipeline size. Existing external gear pumps used for hydraulic applications cannot handle the lower viscosity and reduced lubricating properties of the crude oil, and some other petroleum products, or the typical sand and other particles found in oil wells very well. Further, the low viscosity products and harsh pumping conditions result in the pumps being replaced often, providing higher operational costs.

SUMMARY

This Summary is provided to introduce a selection of concepts in a simplified form that are further described below in the Detailed Description. This Summary is not intended to identify key factors or essential features of the claimed subject matter, nor is it intended to be used to limit the scope of the claimed subject matter.

One or more techniques and systems are described herein for a pump technology that provides for more effective and efficient transfer of liquids, such as petroleum products and components, to and through pipelines. Such a technology can comprise a type of external gear pump that creates higher flow, resulting in higher pressures in the pipeline, to move the liquids, while providing for longer pump life, simpler and less maintenance, and fewer undesired conditions, with a smaller footprint, in a cost-effective system.

In one implementation, a pump for use in a high-pressure pipeline can comprise a pump bracket. In this implementation, the pump bracket can comprise a bearing housing that is disposed proximate a motor coupling end of the pump. The bearing housing is operably holding a bearing assembly that provides support to a pump driver shaft from axial and radial force applied to the driver shaft under load. The pump bracket can further comprise a seal chamber that is disposed distally from the bearing housing. The seal chamber can hold a selectably removable seal that is fixedly engaged with the driver shaft during operation to mitigate leakage of a pumped fluid from inside a pump housing to outside the pump housing. A drive shaft cavity can be disposed in the bracket, running through the bracket, and configured to operably hold the driver shaft.

In this implementation, the pump can comprise a first gear casing that is fixedly engaged with the bracket during operation. The first gear casing can comprise a first gear chamber that operably holds a driver gear and a driven gear, where the driver gear can be meshedly engaged with the driven gear engaged with a first driven shaft in the first gear chamber, and the driver gear can be operably, fixedly engaged with the driver shaft such that the driver gear rotates when the driver shaft is rotated resulting in fluid being drawn into the first gear chamber on a first side, and discharged from the first gear chamber on a second side.

The pump can also comprise a first port and a second port disposed in the pump housing. The first port can comprise a discharge port when the pump is disposed in a clockwise orientation and a suction port when the pump is disposed in a counter-clockwise orientation. Further, the second port can comprise a suction port when the pump is disposed in a clockwise orientation and a discharge port when the pump is disposed in a counter-clockwise orientation. Additionally, the pump can comprise a casing head that is disposed at the distal end of the pump. The casing head can be selectably, fixedly engaged with the gear casing and bracket; and the casing head can comprise a driver shaft end cavity to operably hold the driver shaft, the driver shaft end cavity closed at the distal end inside the casing head.

The pump may also comprise a fixed end plate. The fixed end plate may be positioned within the gear chamber of the gear casing and situated between either the pump bracket and the driver gear and the driven gear, or the driver gear and the driven gear and the casing head.

The pump may also comprise a bearing block. The bearing block may be positioned within the gear chamber of the gear casing and situated between either the pump bracket and the driver gear and the driven gear, or the driver gear and the driven gear and the casing head. The bearing block may be configured to encompass both the driver shaft and the driven shaft.

To the accomplishment of the foregoing and related ends, the following description and annexed drawings set forth certain illustrative aspects and implementations. These are indicative of but a few of the various ways in which one or more aspects may be employed. Other aspects, advantages, and novel features of the disclosure will become apparent from the following detailed description when considered in conjunction with the annexed drawings.

DETAILED DESCRIPTION

Figure 1B:
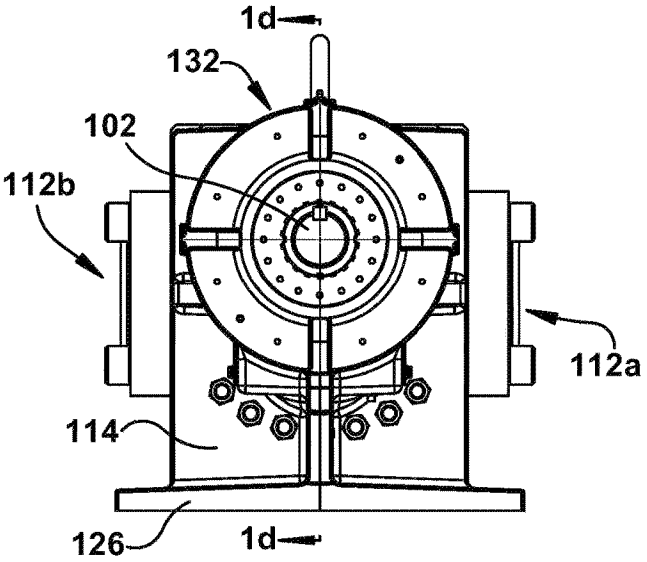
FIGS. 1*a*, 1*b*, 1*c*, and 1*d* are component diagrams illustrating various views of one implementation of an example external gear pump that may be used for pipeline injection.
Figure 1A:
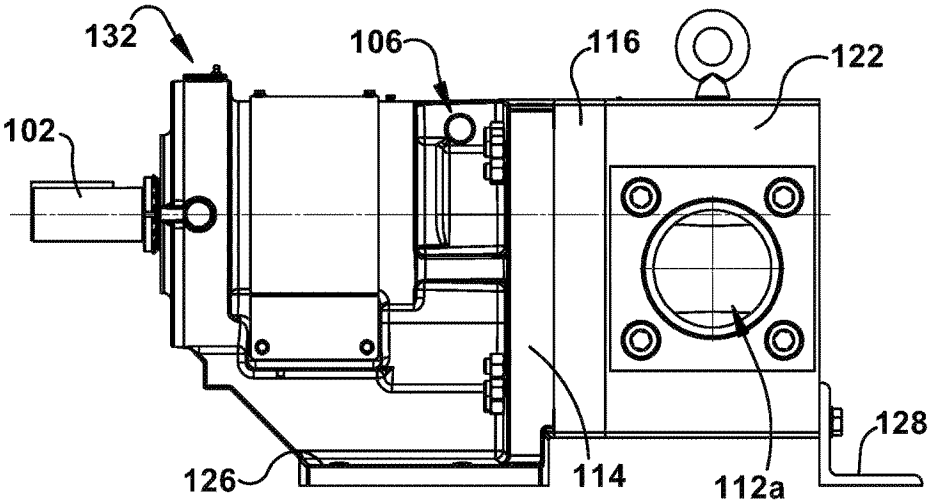
Figure 1C:
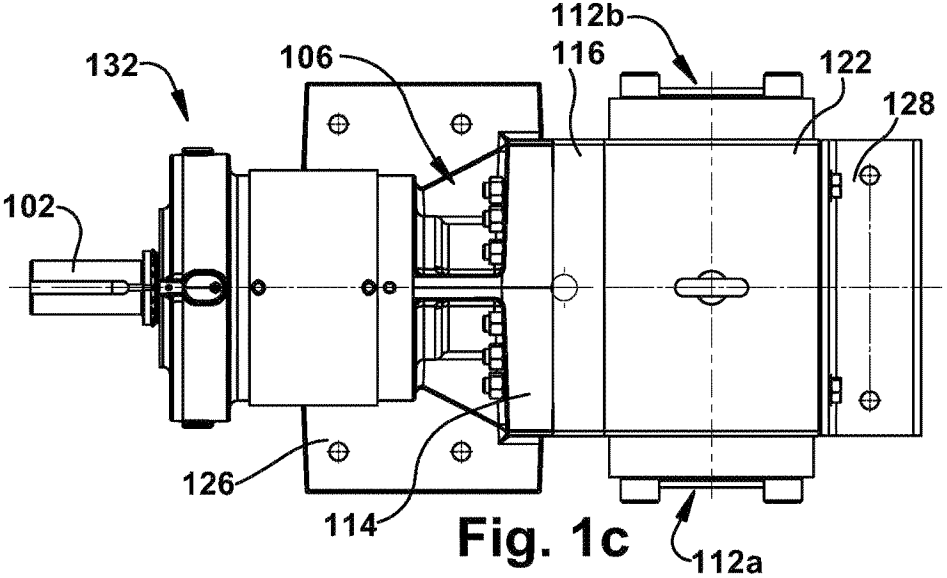

The claimed subject matter is now described with reference to the drawings, wherein like reference numerals are generally used to refer to like elements throughout; however, different implementations of similar elements may be identified with different reference numerals. In the following description, for purposes of explanation, numerous specific details are set forth in order to provide a thorough understanding of the claimed subject matter. It may be evident, however, that the claimed subject matter may be practiced without these specific details. In other instances, structures and devices are shown in block diagram form in order to facilitate describing the claimed subject matter.

Crude oil and other petroleum products and components can be economically transported from the oilfield to the refineries by pipelines, for example, versus over-the-road or rail transport. A pipeline injection pump may be devised that can be used to move crude oil, collecting from multiple wells or truck terminals, for example, into a petroleum product pipeline, and through the pipeline. As one example, due to frictional losses that incur in pipelines over long distances, the pump should be capable of handling very high pressures for low viscosity and low lubricating liquids, such as crude oil. As another example, a booster pump can be devised that may be used in a Lease Automatic Custody Transfer (LACT) unit for pumping petroleum products, such as crude oil, into pipelines at high pressures.

In one aspect, an external gear pump can be devised for use in transport of petroleum products, such as crude oil, while allowing for a more compact solution at a more cost effective price than existing technology. In this aspect, improved material of construction and internal component clearances can allow for improved function for the application of the pump, while allowing for a more compact footprint. As an example, the improved designs can save space used for operation of the pump platform, and can allow for a smaller housing to be used to enclose the pumping units that are in environments, for example, with wet weather and/or freezing temperatures. In this aspect, the improved material of construction and internal component clearances can also provide for a pump operation that is more reliable and has improved operational life over existing technology than existing systems.

Further, in one aspect, a pump can be devised with an innovative bracket design, which may allow for a plurality of mechanical seal options using merely the single, innovative bracket. For example, use of this innovative bracket can allow end users to choose between a standard component seal, a balanced component seal, or a cartridge seal, with provisions for leak detection systems. Additionally, in this aspect, gear sections can be added to the pump to increase the flow rate while maintaining the original pressure rating for the pump. For example, the addition of one or more gear sections to a pump may be like having two, three, or more pumps, but with merely one seal and one prime mover. In one implementation, in this aspect, innovative machining of pump separation plates and heads can also be provided to allow the orientation of some parts to be flipped, to achieve a clockwise (CW) or counter-clockwise (CCW) build using the same part. That is, for example, one or more internal parts can be flipped around to have the pump flow in the opposite direction, instead of changing the input and output piping connected to the pump.

A pipeline injection pump may be devised that provides for petroleum product to be injected into a transport pipeline at high pressure, for example, in order to overcome the high pressure present in the pipeline transport system. In one implementation, an external gear pump can comprise improved material of construction and internal clearances designed for the application, allowing for a more compact solution. Further, a bracket design allows for the use of cartridge mechanical seal options with provisions for leak detection systems, and can accept API 682 compliant seals. In one implementation, the bracket can also incorporate a bearing housing configured to facilitate maintenance of the alignment of the shaft and to help carry axial or radials loads that may be applied to the shaft. Additionally, gear sections can be added to the modular pump design to increase the flow rate while maintaining the same pressure rating.

FIGS. 1-6 illustrate various views of various implementations of a pipeline injection pump system. These example pump systems 100, 200, 300, 600 illustrate one or more implementations of a pump system that utilizes an external gear pump design, having material of construction and internal clearances designed for the application allowing for a more compact solution. In one aspect, an innovative bracket design allows for a variety of cartridge mechanical seal options, with provisions for leak detection systems, which can accept API 682 compliant seals. In these examples, an innovative bracket design can also incorporate a bearing housing to help keep the shaft aligned and carry applied axial or radials loads. Further, in some implementations, as illustrated, additional gear sections can be added to the design to increase the flow rate while maintaining a same pressure rating. For example, this is essentially like having two, three, or more pumps, but with only one seal and one prime mover.

As an example, the innovative pump systems 100, 200, 300, 600 illustrated can provide an alternative positive displacement pump technology to the currently applied reciprocating pumps. For example, reciprocating pumps are extremely large, and they create a high pulsating flow that requires dampeners to reduce damage to the pipeline. The innovative external gear design described herein can produce a much smoother operation, and that can mitigate the need for the dampeners. Further, other existing pump systems use packing to seal the plungers, which leads to leakage of the pumped product (e.g., oil) onto the ground creating environmental concerns. The innovative pump system described herein mitigates the need to use this type of packing. Additionally, centrifugal pumps that are utilized for similar systems are very long due to the need for multiple stages to attain the high-pressure rating. Because centrifugal pumps create pressure rather than flow, like positive displacement pump, they operate on a different type of curve where the flow rate is greatly dependent on the pressure needed to inject the crude oil into the pipeline. These centrifugal pumps require complex controls systems or valves to keep the pump operating at a specific flow on its curve.

FIGS. 1*a*, 1*b*, 1*c*, and 1*d* are component diagrams, respectively illustrating a side view, a front view, a top view, and a side sectional view of an example pipeline injection pump 100, described herein. In this implementation, the example pump 100 may be used to inject petroleum product into a pipeline at elevated pressures, and provide for boosting or moving the product through the pipeline, such as from a storage facility to a remote refinery or storage facility.

In this implementation, as illustrated in FIGS. 1*a*-1*d*, the example pump 100 comprises a single gear pair configuration. The example pump 100 comprises a driver shaft 102 (e.g., a.k.a. drive shaft), which may be coupled with a motor during operation (operably coupled), to provide rotational power to the driver shaft 102. Further, fixedly engaged with the driver shaft 102 is a driver gear 108. Rotation of the driver shaft 102, such as by an operably coupled motor, results in rotation of the driver gear 108. The example pump 100 also comprise a driven gear 110, which, during operation (operably), is meshedly engaged with the driver gear 108. That is, for example, as the driver gear 108 rotates, due to rotation of the driver shaft 102, the meshed engagement with the driven gear 110 results in rotation (e.g., in an opposite direction) of the driven gear 110.

Figure 1D:
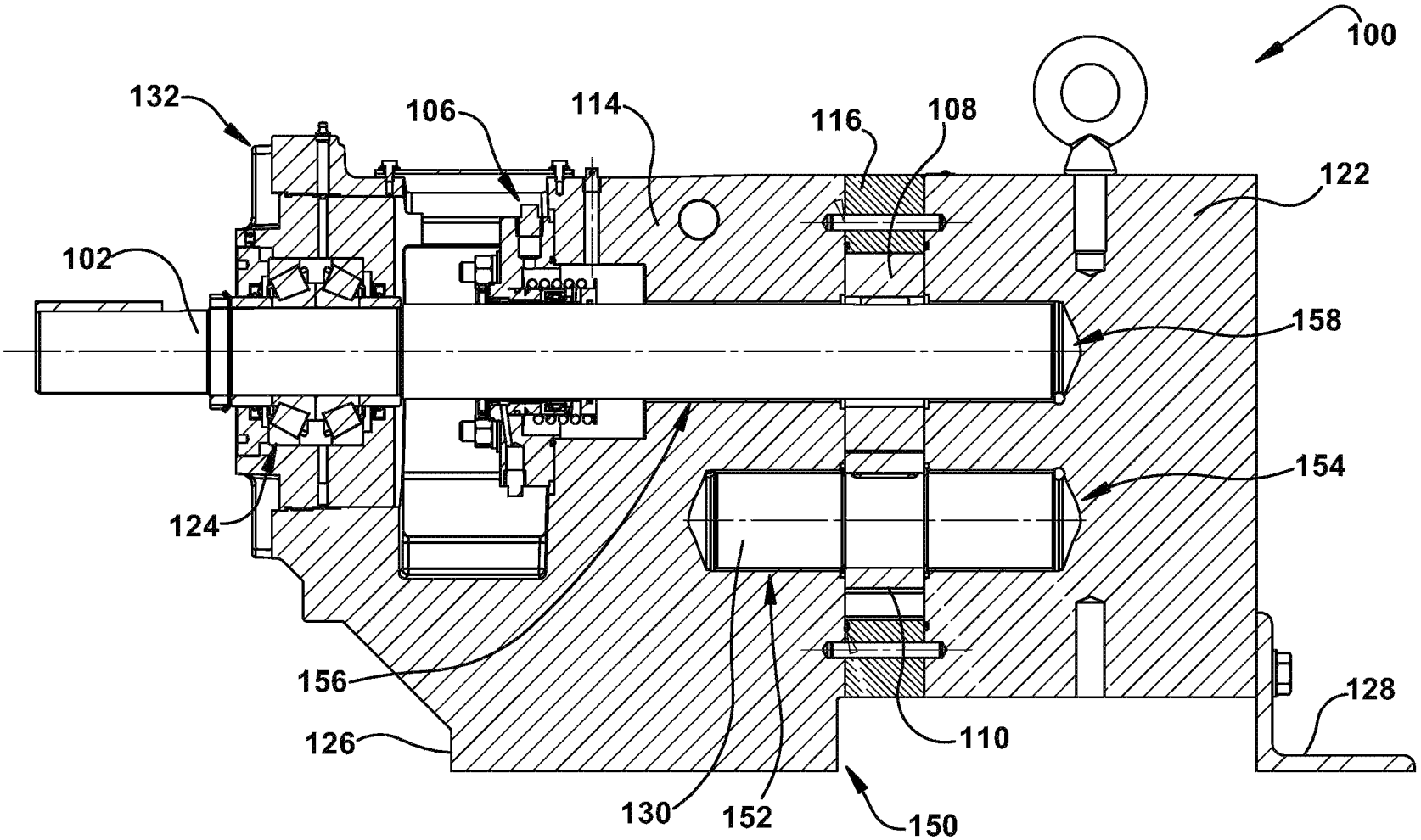
Figure 2B:
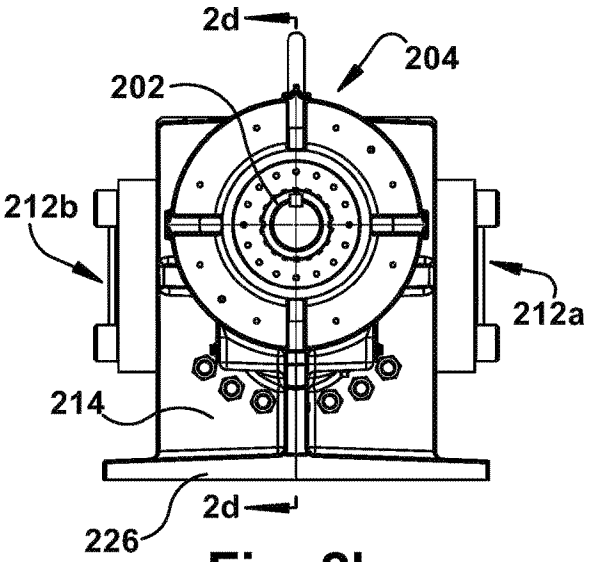
FIGS. 2*a*, 2*b*, 2*c*, and 2*d* are component diagrams illustrating various views of another implementation of an example external gear pump that may be used for pipeline injection.
Figure 2A:
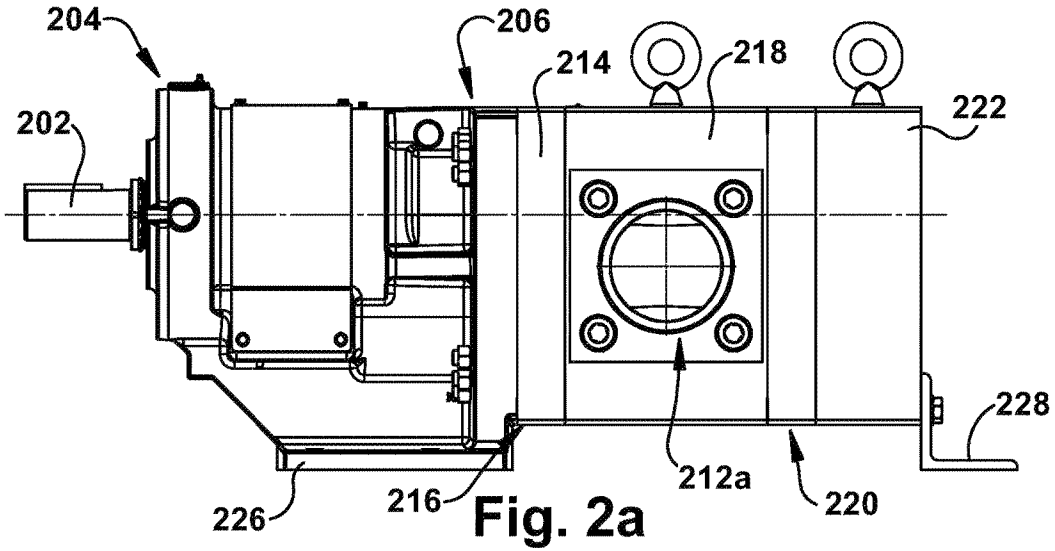
Figure 2C:
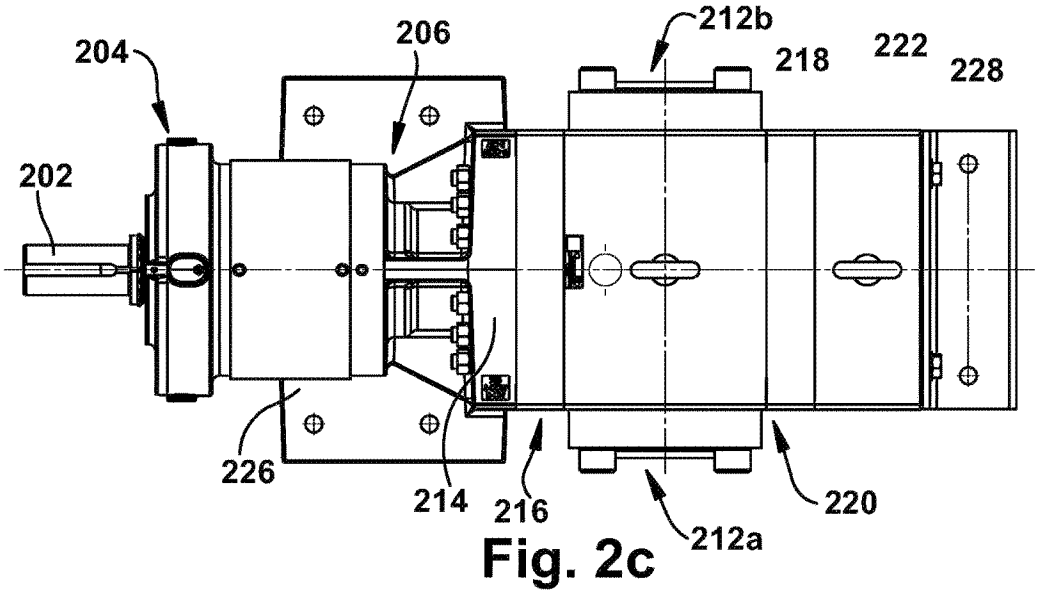
Figure 2D:
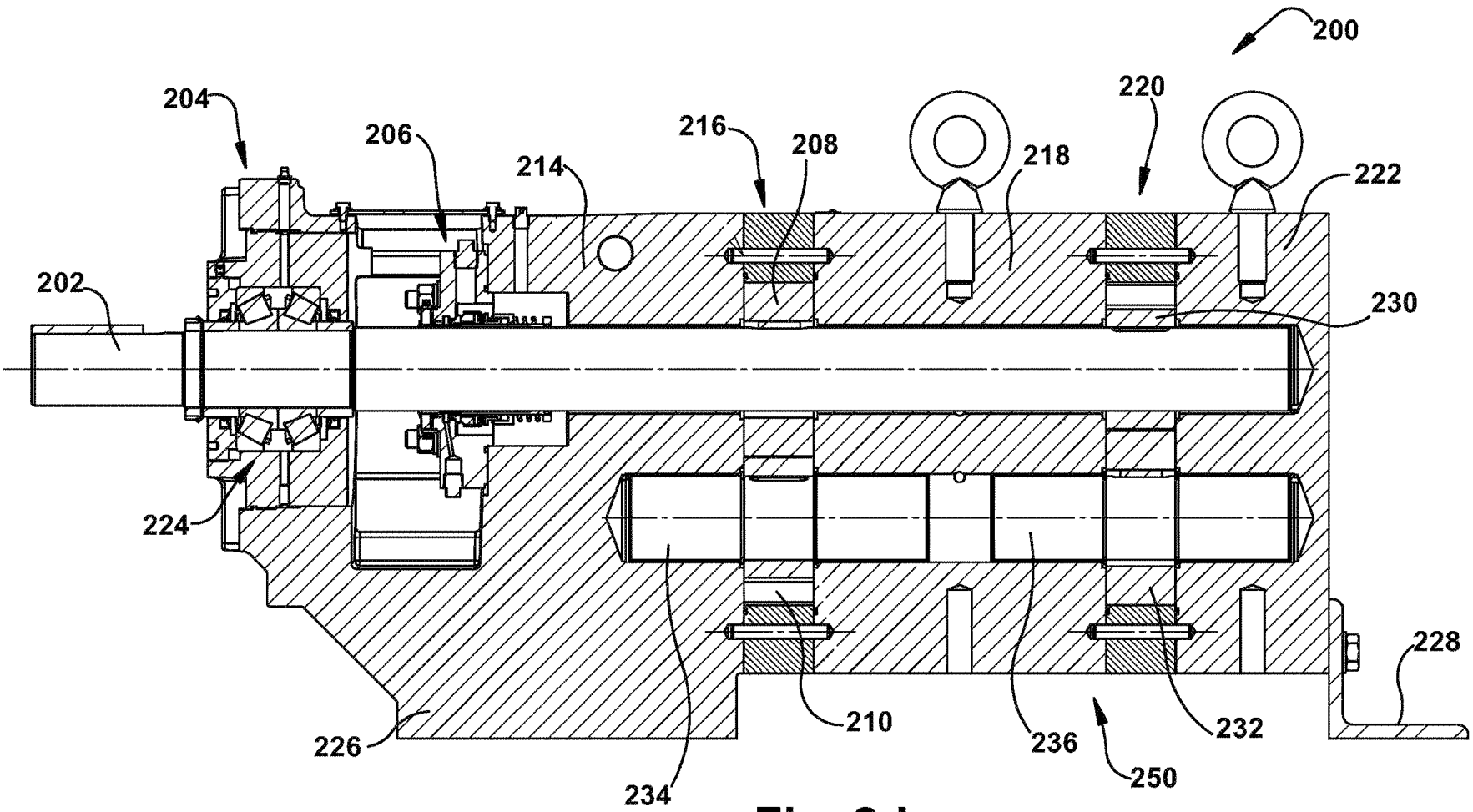

Additionally, the driven gear 110 is fixedly engaged with a driven shaft 130, which rotates substantially freely inside the housing 150 of the pump 100. The example pump 100 comprises a bracket 114, a gear casing 116, and a casing head 122. In this implementation, the bracket 114, gear casing 116, and the casing head 112 form the housing 150 of the pump 100. As illustrated in FIG. 1*d*, the bracket 114 and casing head 122 portions of the housing 150 respectively comprise a driven shaft cavity 152, 154. The respective driven shaft cavities 152, 154 are configured to receive the appropriate portions of the driven shaft 130, to allow the driven shaft 130 to rotate substantially freely around its axis, and to provide support to the driven shaft 130 such as when axial and/or radial loads are applied to the driven gear 110. In one implementation, the clearance between a wall of the respective driven shaft cavities 152, 154 and the complementary surface of the driven shaft 130 can be such that deviation from the axis of rotation of the driven shaft 130 is mitigated when axial and/or radial loads are applied. In this implementation, for example, the tolerance of the respective complementary surfaces of the shaft 130 and cavities 152, 154 is very low to accommodate the improved support of the shaft during application of loads to the driven gear 110.

As illustrated in FIG. 1*d*, the bracket 114 and casing head 122 portions of the housing 150 respectively comprise a driver shaft cavity 156, 158. The respective driver shaft cavities 156, 158 are configured to receive the appropriate portions of the driver shaft 102, to allow the driver shaft 102 to rotate substantially freely around its axis, and to provide support to the driver shaft 102 such as when axial and/or radial loads are applied to the driver gear 108. In one implementation, the clearance between a wall of the respective driver shaft cavities 156, 158 and the complementary surface of the driver shaft 102 can be such that deviation from the axis of rotation of the driver shaft 102 is mitigated when axial and/or radial loads are applied. In this implementation, for example, the tolerance of the respective complementary surfaces of the shaft 102 and cavities 156, 158 is small to accommodate the improved support of the shaft during application of loads to the driver gear 108.

In one implementation, the example pump 100 can comprise a seal 106 that provides a leak barrier between the inside and outside of the pump 100, at the location where the rotating shaft 102 enters the pump 100, to mitigate leakage of a pumped fluid out of the pump 100. In one implementation, the seal 106 can comprise a back pull out seal, which can be configured to allow removal of the seal 106 (e.g., and other pump components, such as a coupling, bearing, etc.) without disturbing the pump housing or pipework coupled with the pump 100. That is, for example, when maintenance is performed on the pump, such as replacing a seal or other component, the seal may be pulled out without removing or uncoupling the piping from the pump housing. For example, this can provide for less costly, faster, and easier maintenance, and mitigate potential down time and damage to other parts of the pipeline injection system. As an example, an advantage of this design is that the rotating assembly, including any bearings and shaft seals, may be readily pulled out of the pump casing. In this example, this design allows internal components to be inspected and replaced without having to remove the casing from the piping or platform.

As illustrated in FIGS. 1*a*-*d*, the example pump 100 can comprise a bearing housing 132 comprising a bearing assembly 124. In one implementation, the bracket 114 can comprise the bearing housing 132, which can be used to help keep the shaft 102 aligned and carry axial or radials loads that may be applied to the shaft. In one implementation, the bearing assembly 124 can comprise tapered roller thrust bearings. For example, tapered roller thrust bearings can be used to accommodate heavy axial and/or radial loads, and peak loads. In this way, for example, they may mitigate deviation of the shaft from its axis of rotation under heavy loads during operation. Further, as described above, the innovative bracket 114 can be configured to allow the bearing assembly 124 to be removed, inspected, and/or replaced without disturbing the remaining portions of the pump housing 150, including the attached piping. That is, for example, the bracket 114 can be removed to access the bearing assembly 124, the seal 106, and other portions of the pump 100 without removing the gear casing 116, and/or the casing head 122.

In this implementation, the casing head 122 of the pump comprises a first port 112*a* and a second port 112*b*. In one implementation, the first port 112*a* can comprise a pump outlet or discharge port, and the second port 112*b* can comprise a pump inlet or suction port. In this implementation, the pump can be configured in a clockwise (CW) configuration. In another implementation, the first port 112*a* can comprise a pump inlet or suction port, and the second port 112*b* can comprise a pump outlet or discharge port. In this implementation, the pump can be configured in a counter-clockwise (CCW) configuration. As an example, in these implementations, the casing head 122 can be configured to operate in a CW or CCW configuration, merely by flipping or rotating the orientation of the casing head 122 around its central axis, which is parallel to the axis of rotation of the shaft 102.

That is, for example, the casing head 122 can be rotated one-hundred and eighty degrees around the central axis so that the ports 112 are disposed in an opposite configuration as prior to the rotation. Further, the casing head 122 can be marked (e.g., stamped, labeled, etc.) at the respective ports denoting the discharge side and suction side, and marked with CW and CCW depending on the orientation of the casing head 122. As one example, the casing head 122 may be marked at the discharge port (e.g., 112*a*) with a CW when disposed in that orientation and an upside down CCW may also be marked on the casing head 122 proximate the discharge port (e.g., 112*a*). In this example, when the casing head 122 is rotated one-hundred and eighty degrees around its central axis, the discharge port may be disposed on the opposite side (e.g., 112*b*). In this orientation, the CCW will now appear upright, and the CW will appear upside down. This may serve as an indicator to the pump operator as to the operation of the pump, as rotating in a clockwise or counterclockwise orientation. In this implementation, the casing head 122 is modular, and does not need to be swapped out with a different casing head. Further, the innovative design of the gear casing 116 and bracket 114 as coupled with the casing head allow the respective parts to be modular, allowing for rotation of some parts, and addition of more gear sections, as described below.

As illustrated, the example, pump 100 comprises a first driver gear 108 and a first driven gear 110. The first driver gear 108 is fixedly engaged with the driver shaft 102 during operation (operably), and the first driver gear 108 rotates as the driver shaft 102 rotates. Further, the first driven gear 110 is fixedly engaged with the first driver shaft 130, and the rotation of the first driver gear 108 results in rotation of the first driven gear 110, due to the meshed engagement of the respective gears. In an external gear pump, the meshed engagement and rotation of the first driver gear 108 and first driven gear 100 result pumping of a fluid between the inlet port (e.g., 112*b*) and the outlet port (e.g., 112*a*). For example, the respective gears 108, 110 rotate inside pumping chambers (not shown) inside the gear casing 116, which are fluidly coupled with the respective ports 112. Additionally, the gears 108, 110 can be engaged with the respective shafts 102, 130 by various methods. For example, the gear may be press-fit on the shaft; alternately, the gear may be floated on the drive shaft with retaining rings. As an example, floating the gear on the shaft may help mitigate the gear from locking onto the drive shaft, for easier removal.

In one implementation, the driver shaft 102 can be locked to the bearing housing 132, instead of the gears, for example, in order to accept axial thrust with a thrust bearing. For example, this can allow a user to access the seal 106 while the pump remains in place, such as at an installation. In this example, the seal 106 can be pulled out through the same access hole, allowing the pump 100 to remain in place without further disassembly. In one implementation, the gear teeth shape can be designed to improve flow rates and pressures. For example, a fourteen and one half inch gear size can comprise a twenty-degree tooth angle. As another example, a courser gear tooth ratio may provide for improved flow rates and pressures for certain implementations. An involute gear tooth profile may also provide for improved operation. In one or more of these examples, if the gear geometry is changed the housing may need to be changed as well.

In the example implementation, the example pump 100 can comprise a bracket foot 126 and a casing foot 128. The bracket foot 126 can be part of or fixed to the bracket 114; and the casing foot 128 can be fixed to or part of the casing head 122. In this implementation, the bracket foot 126 and casing foot 128 can be used to fasten the pump 100 to a stationary platform, such as at the location where pumping of the product is desired. That is, for example, the respective feet 126, 128 can comprise fastening vias that allow a fastener to pass through to fasten to the stationary platform, in order to hold the pump 100 to the platform.

FIGS. 2*a*-2*d* are component diagram illustrating one implementation of an example pipeline injection pump 200 comprising two sets of external pumping gears. As illustrated, the example double gear pump 200 comprises a second driver gear 230 and a second driven gear 232, respectively, operably fixed to the driver shaft 202 and a second driven shaft 236. As an example, the addition of a second set of pumping gears can provide for a significant increase in pumping ability (e.g., flow rates and volumes), up to double the capacity of a single gear pair. In this implementation, the modular design of the bracket 214, first gear casing 216, second gear casing 220, separator plate 218, and casing head 222, allow for modular addition of gear sets. For example, as illustrated, the bracket 214 may be the same design/type (or same) bracket 114 found in the example pump 100 of FIG. 1; and the first gear casing 216 may be the same design/type (or same) gear casing 116 found in the example pump 100 of FIG. 1. In this example, in this modular design, the separator plate 218, the second gear casing 220, and casing head 222 can be fixedly engaged with the bracket 214 and first gear casing 216 of the same design to create the new, double gear pump 200.

Further, in this example implementation, the pump 200 can comprise a driver shaft 202 that is longer than the driver shaft 102 of pump 100, in order to accommodate the second set of pump gears 230, 232. Further, the example pump 200 comprise a first driven shaft 234, which is operably, fixedly engaged with the first driven gear 210. The example, pump 200 comprises a second driven shaft 236, which is operably, fixedly engaged with the second driven gear 232. In this example, a bearing housing 204 can comprise a bearing assembly 224, which may help stabilize the driver shaft 202, by mitigating axial and radial movement. Additionally, a seal 206 may be engaged with the shaft 202 at a location where the shaft 202 enters the pump housing 250. The seal can mitigate leakage of a pump fluid from inside the pump to the outside of the pump 200.

In this implementation, the separator plate 218 of the example, pump 200 can comprise a first port 212*a* and a second port 212*b*. The first port 212*a* and second port 212*b* are in fluid communication with the first gear casing 216 and second gear casing 220, such that fluid pumped by the by the respective gears 208, 210, 230, 232 inside the respective gear casing 216, 220, may be drawn in through one of the ports and out of the other port, depending on the orientation of the pump. That is, for example, the first port 212*a* can comprise an outlet or discharge port, and the second port 212*b* can comprise an inlet or suction port, such as when the pump is oriented in a clockwise (CW) orientation. Further, for example, the first port 212*a* can comprise the inlet or suction port, and the second port 212*b* can comprise outlet or discharge port, such as when the pump is oriented in a counter-clockwise (CCW) orientation. As described above for the casing head 122 in FIG. 1, in one implementation, the separator plate 218 may comprise a modular design that allows it to be rotated one-hundred and eighty degrees around its central axis to provide appropriate CW and CCW markings for the installer of the pump. These markings allow the installer to readily view on which side the suction and discharge ports are disposed, based on the CW or CCW orientation of the pump.

Additionally, the example, pump 200 can comprise a bracket foot 226 and a casing foot 228. The bracket foot 226 can be part of or fixed to the bracket 214; and the casing foot 228 can be fixed to or part of the casing head 222. In this implementation, the bracket foot 226 and casing foot 228 can be used to fasten the pump 200 to a stationary platform, such as at the location where pumping of the product is desired. That is, for example, the respective feet 226, 228 can comprise fastening vias that allow a fastener to pass through to fasten to the stationary platform, in order to hold the pump 200 to the platform.

Figure 3:
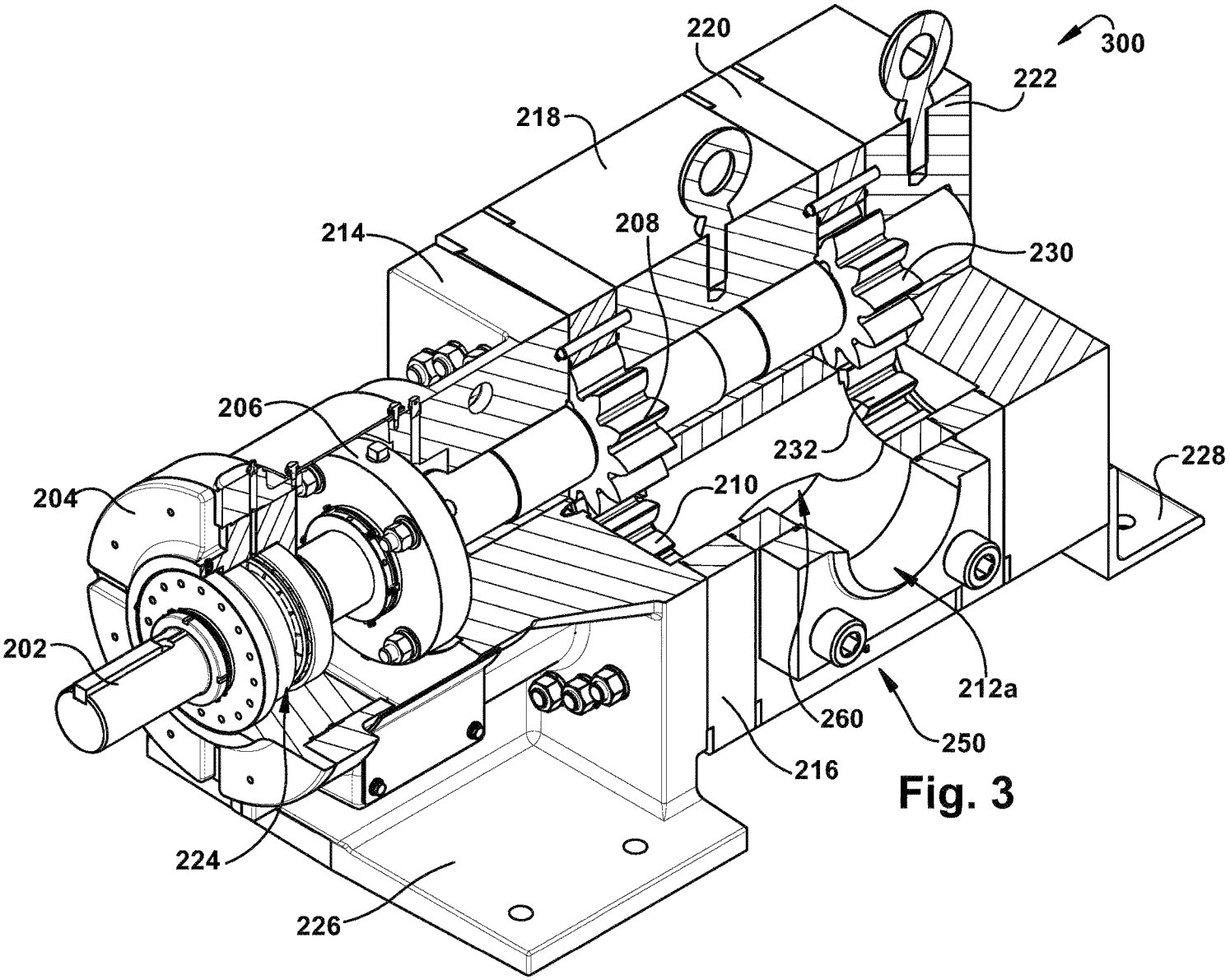
FIG. 3 is a component diagram illustrating an example implementation of one or more portions of one or more systems described herein.

FIG. 3 is a component diagram illustrating a cut-away perspective view of one implementation of an example double gear set pump 300. In this implementation, the respective parts of the pump are numbered according to the FIGS. 2*a*-2*b*. Further, FIG. 3 illustrates a first pumping chamber 260 disposed in the separator plate 218 of the pump housing 250. As illustrated, the first pumping chamber 260 is fluidly coupled with the first gear casing 216 and the second gear casing 220, and is fluidly coupled with the first port 212*a*. Further, although not illustrated, the separator plate 218 can comprise a second pumping chamber, which is disposed on the opposite side of the separator plate 218. The second pumping chamber is fluidly coupled with the first gear casing 216 and second gear casing 220, and is fluidly coupled with the second port 212*b*. In this way, for example, the first and second driver gears 208, 230 can be rotated by the driver shaft 202, resulting in rotation of the first and second driven gears 210, 232 that are meshedly engaged with the first and second driver gears 208, 230. In this example, the rotation of the meshed gears results in fluid to be drawn into the suction port (e.g., 212*b*), into the second pumping chamber, through internal chamber in the respective gear casings 216, 220, between respective gears, out into the first pumping chamber 260, and out the discharge port (e.g., 212*a*).

Figure 4:
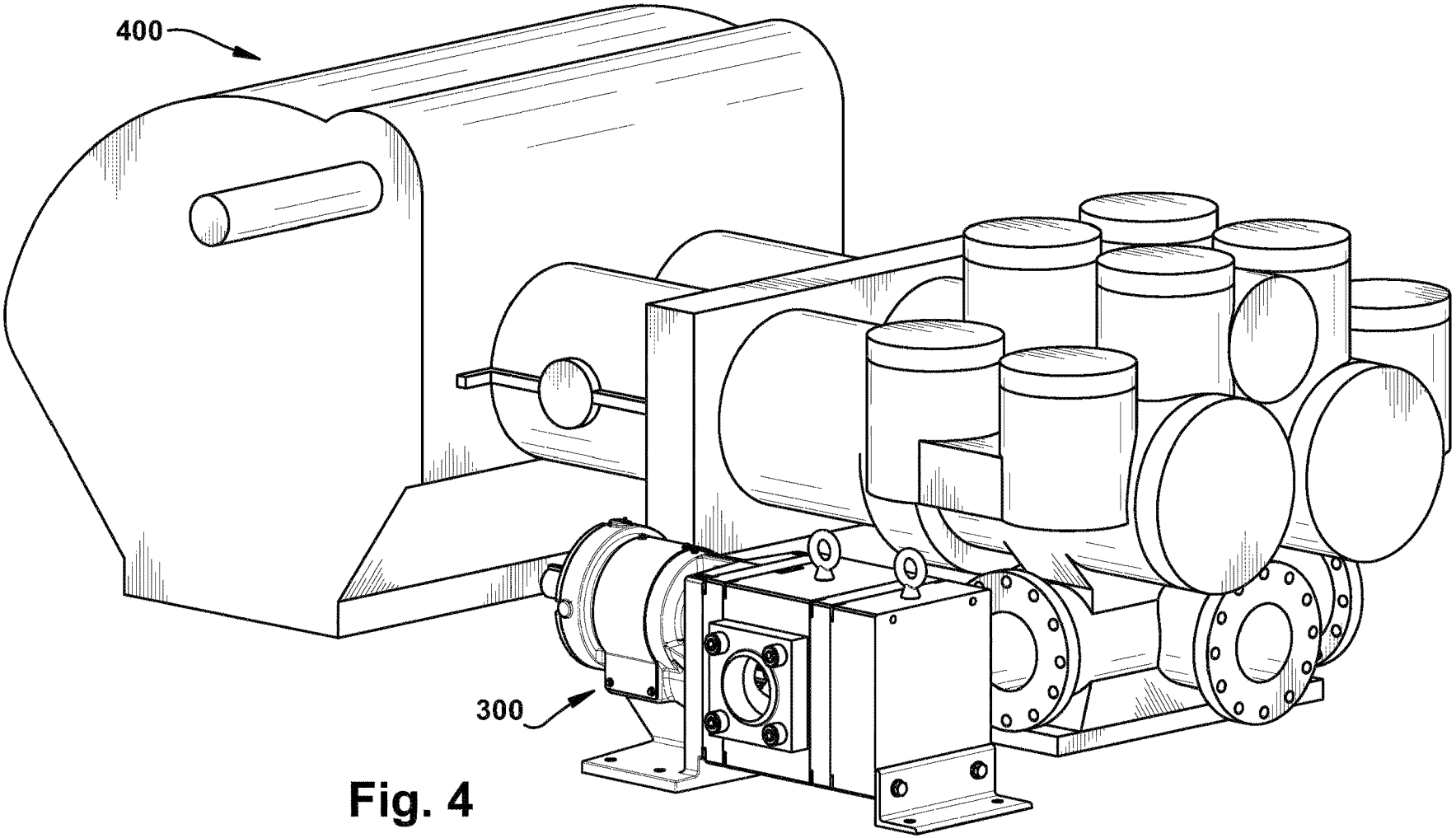
FIG. 4 is a component diagram illustrating an example embodiment where one or more portions of one or more systems, described herein, may be implemented.
Figure 5:
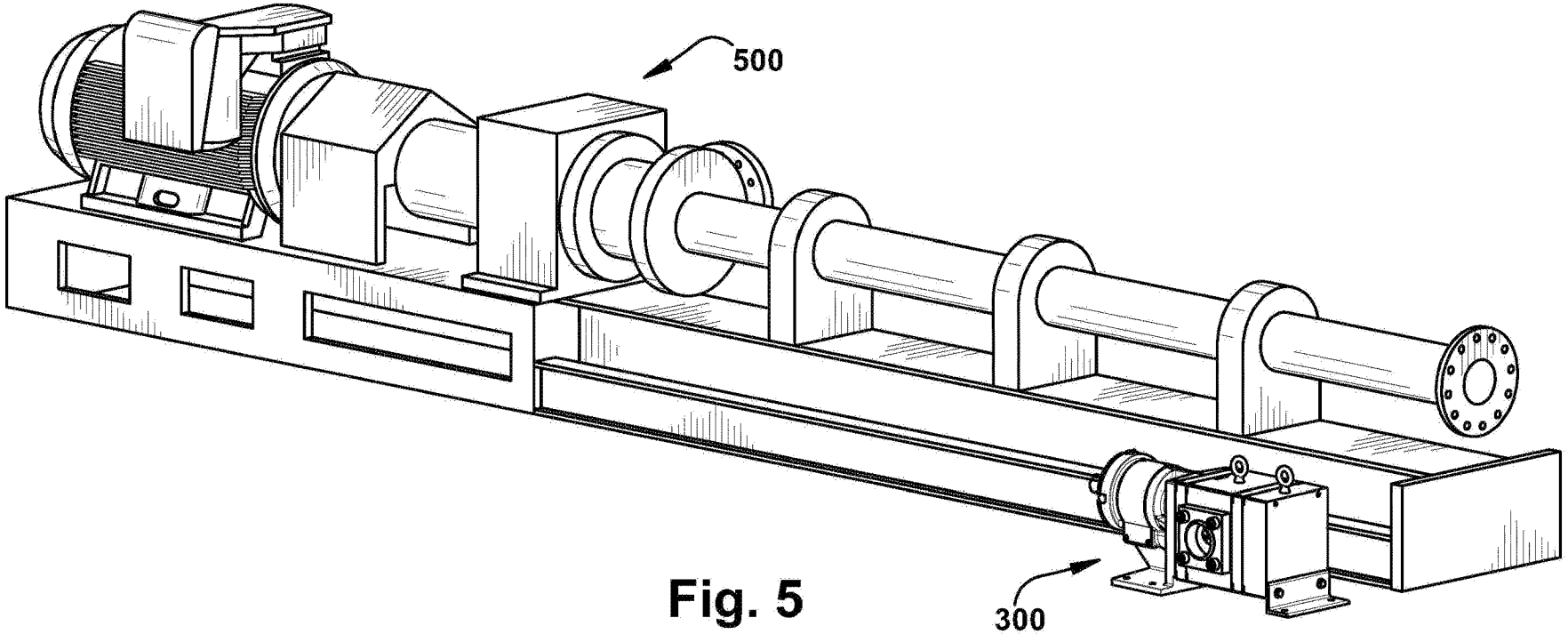
FIG. 5 is a component diagram illustrating an example embodiment where one or more portions of one or more systems, described herein, may be implemented.
Figure 6B:
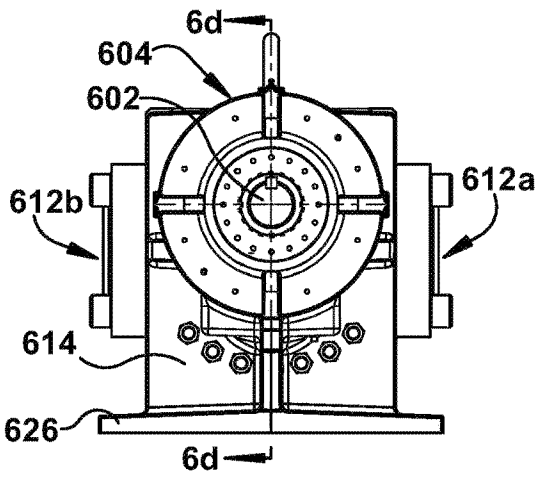
FIGS. 6*a*, 6*b*, 6*c*, and 6*d* are component diagrams illustrating various views of yet another implementation of an example external gear pump that may be used for pipeline injection.
Figure 6A:
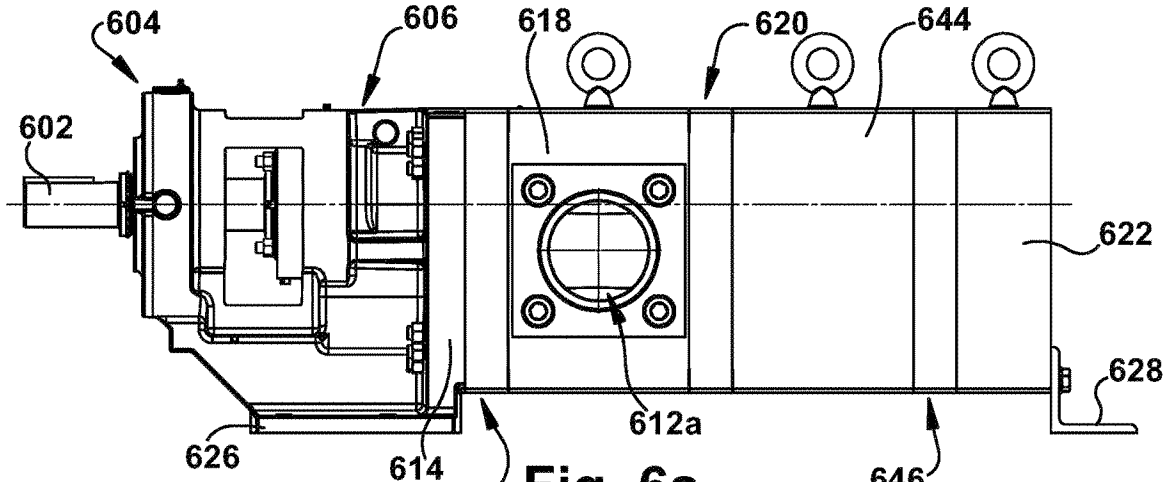
Figure 6C:
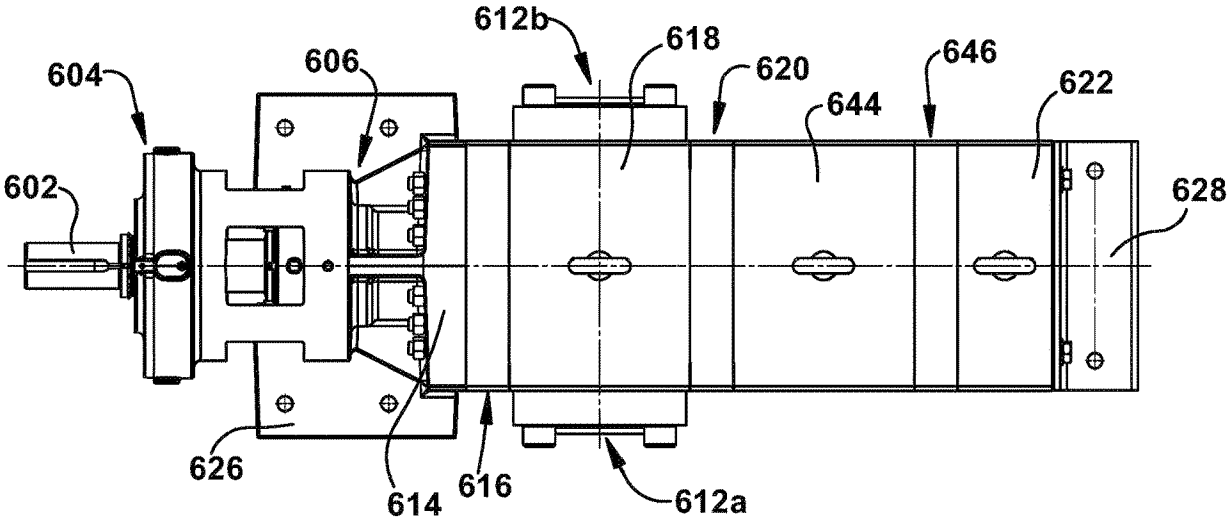
Figure 6D:
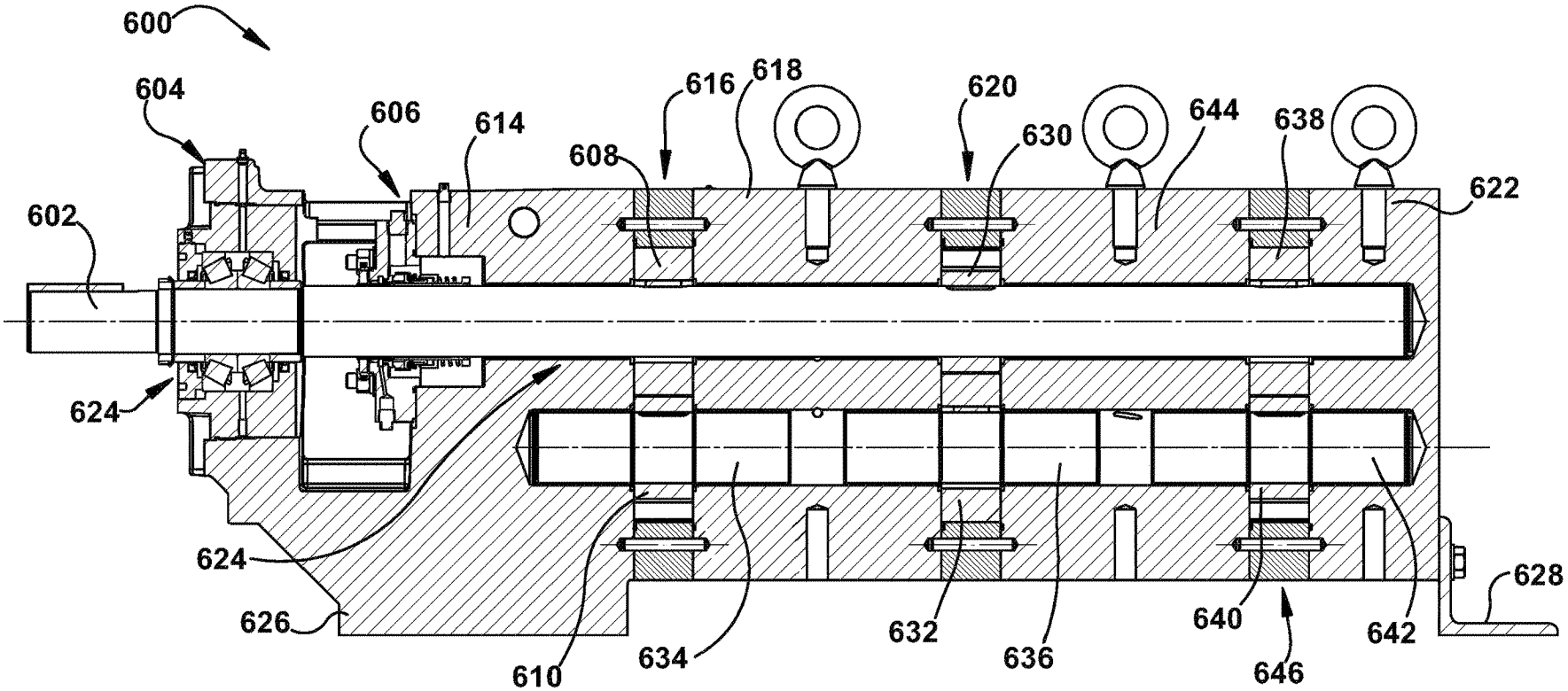
Figure 7A:
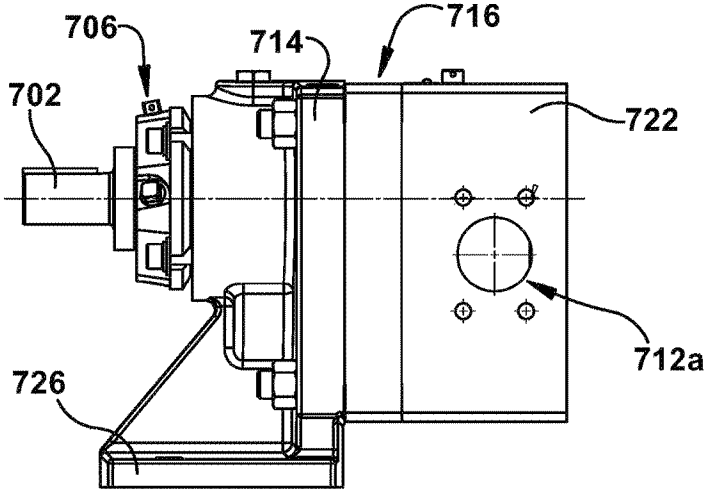
FIGS. 7*a*, 7*b*, 7*c*, and 7*d* are component diagram illustrating various view of one implementation of an example external gear pump that may be used for LACT purposes.
Figure 7B:
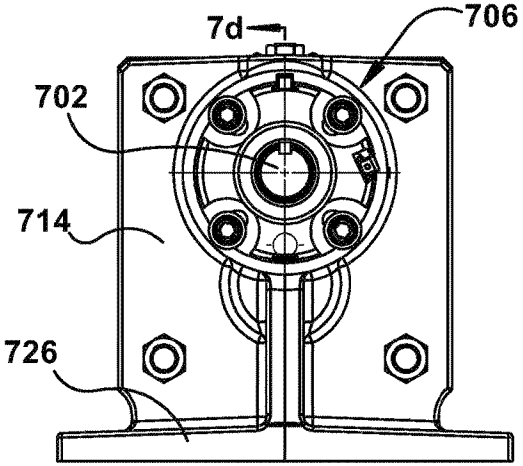
Figure 7C:
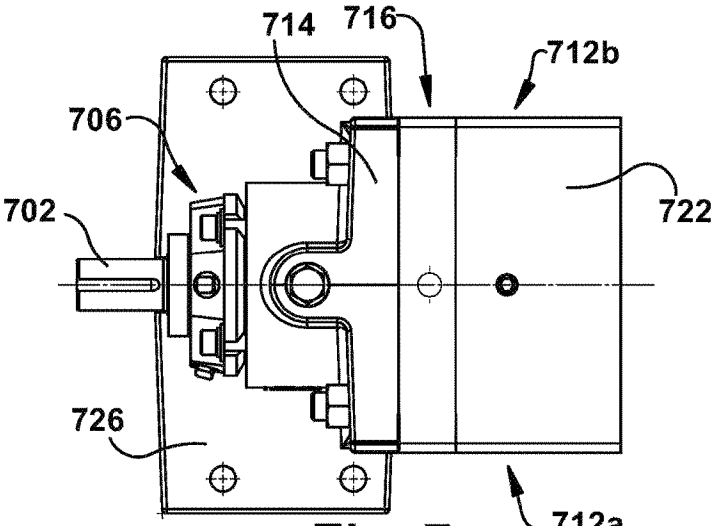
Figure 7D:
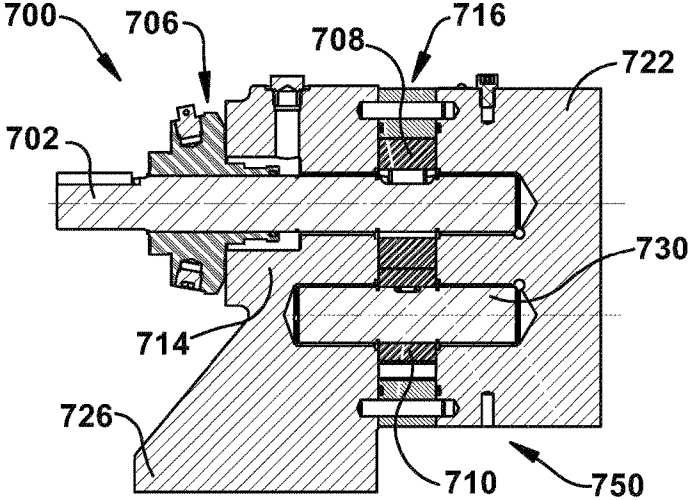
Figure 8A:
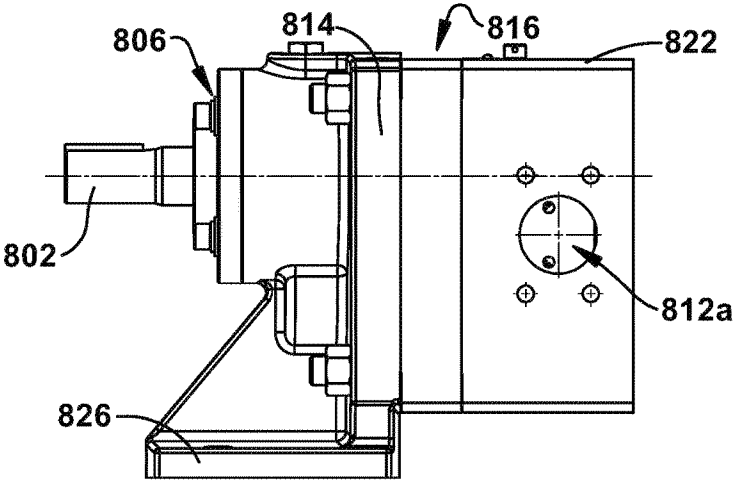
FIGS. 8*a*, 8*b*, 8*c*, 8*d*, and 8*e* are component diagram illustrating various view of another implementation of an example external gear pump that may be used for LACT purposes.
Figure 8B:
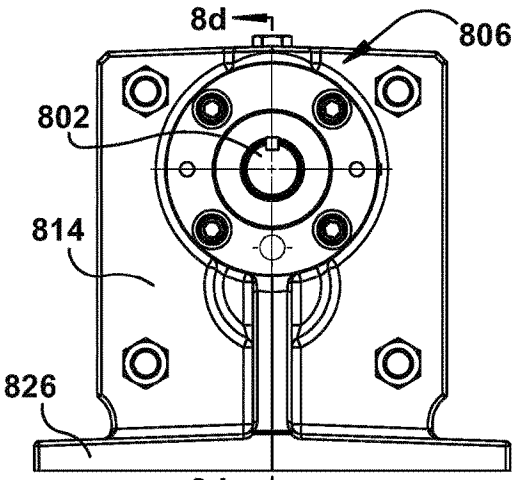
Figure 8C:
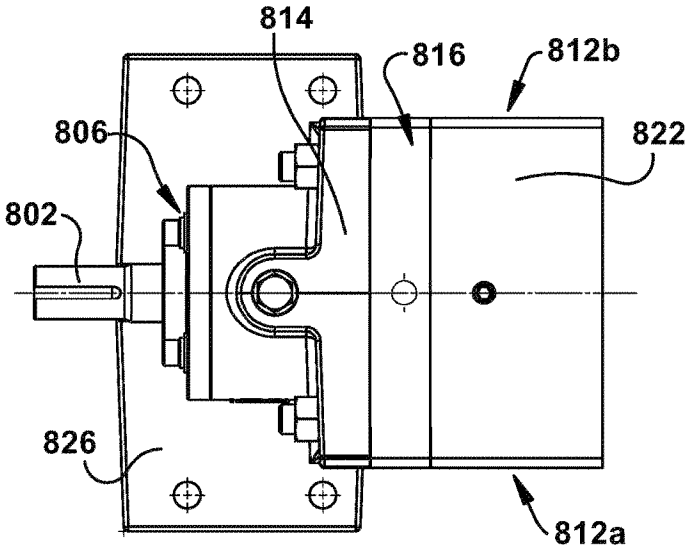
Figure 8D:
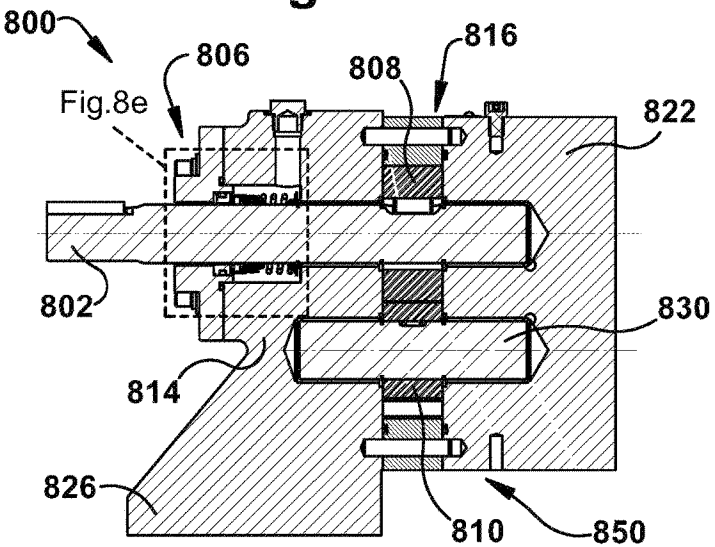
Figure 8E:
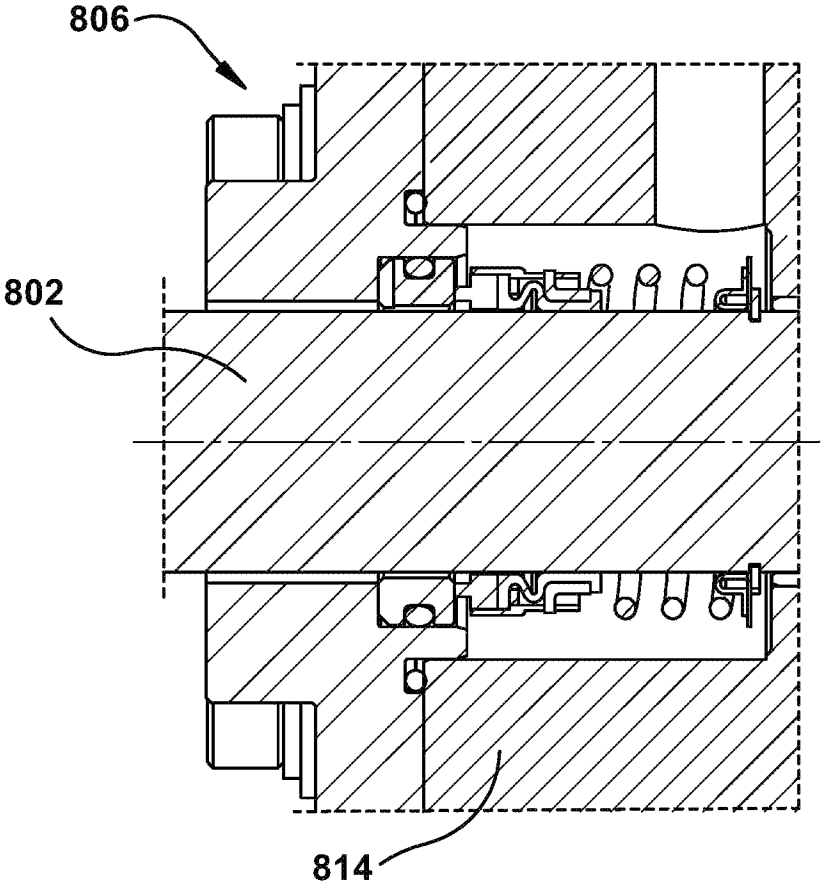
Figure 9B:
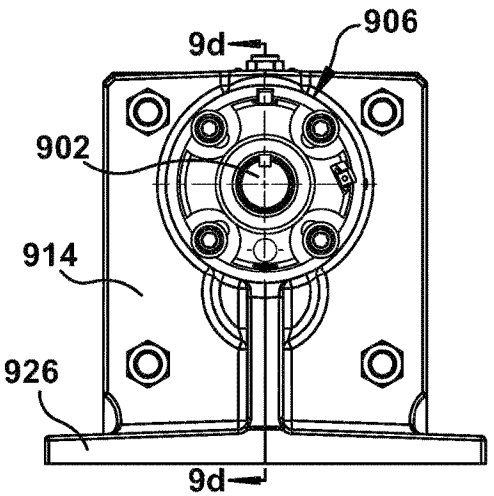
FIGS. 9*a*, 9*b*, 9*c*, and 9*d* are component diagram illustrating various view of yet another implementation of an example external gear pump that may be used for LACT purposes.
Figure 9A:
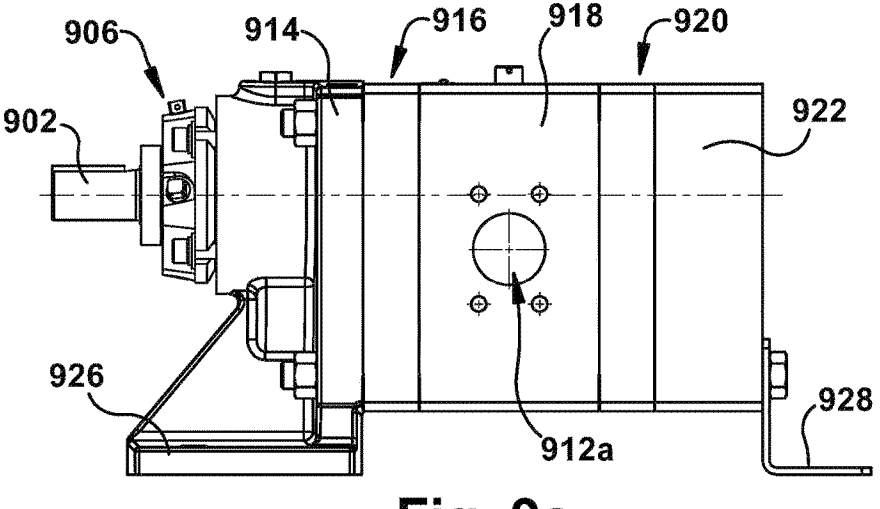
Figure 9C:
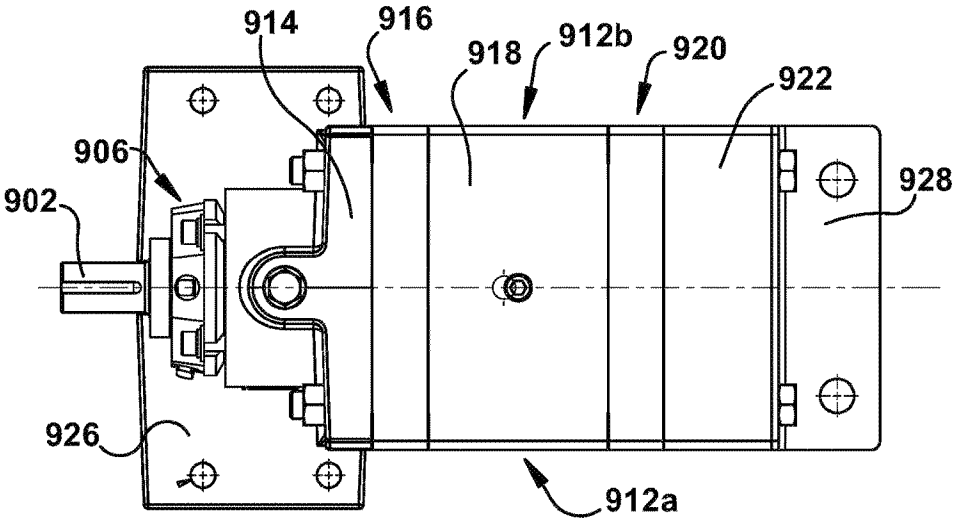
Figure 9D:
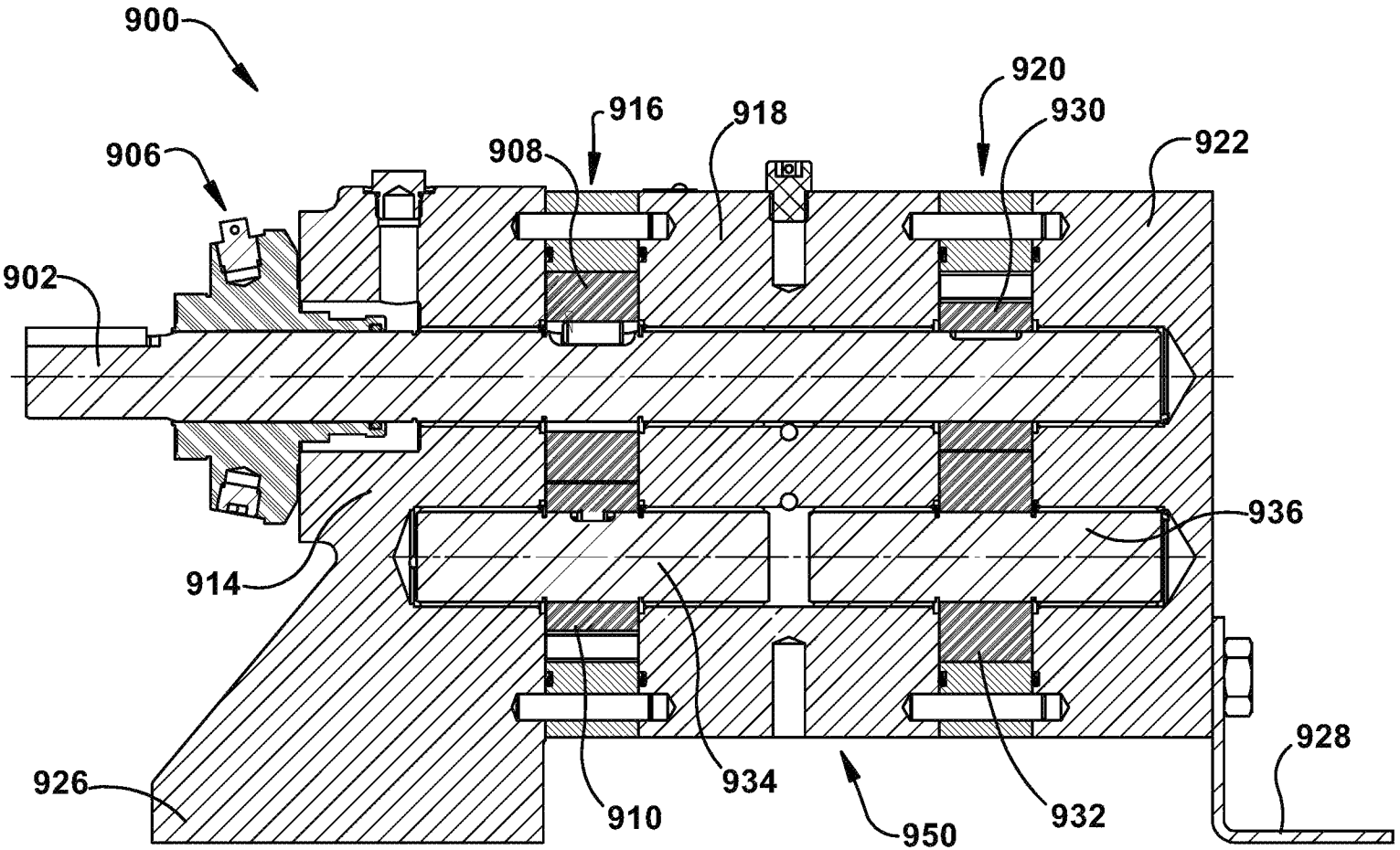

FIGS. 4 and 5 are component diagrams illustrating differences between the example innovative pump 300, described herein, and existing pumps 400, 500 used for similar situations. As illustrated in FIG. 4, the example innovative pump 300, described herein, can provide a much smaller footprint than an existing reciprocating style or piston style pump 400, which may be used for pipeline injection situations. Further, as illustrated in FIG. 5, the example innovative pump 300, described herein, can provide a much smaller footprint than an existing centrifugal style pump 400, which may be used for pipeline injection situations. Additionally, the example pump 300, described herein, can provide for improved flow rates and pressure ratings. For example, this type of pump 100, 200, 300 may be used to move a fluid product at up to 1,500 PSI or more through a pipeline; and may be able to generate a flow rate of up to 15,000 barrels per day or more. In another implementation, the pump 100, 200, 300 may be used to move a fluid product at about 500 PSI or any incremental pressure amount up to 1,500 PSI. In one implementation, a six-hundred horsepower motor may be implemented to power the driver shaft to achieve this type of flow rate and pressure, while maintaining a smaller footprint. As another example, the external gear design (e.g., 300) can help eliminate the need for pulsation dampeners, gear reducers, belt drives, or additional equipment to service and maintain, which is typically needed when operating a reciprocating/piston 400 or centrifugal style pump 500 existing today.

FIGS. 6*a*-6*d* are component diagram illustrating one implementation of an example pipeline injection pump 600 comprising three sets of external pumping gears. As illustrated, the example triple gear pump 600 comprises a first driver gear 608, second driver gear 630, and third driver gear 638. Further, the example pump 600 comprises a first driven gear 610, a second driven gear 632, and a third driven gear 640. The respective driver gears 608, 630, 638 are respectively, operably fixed to the driver shaft 602, which is longer that the single and double gear pump driver shafts 102, 202. The driven gears 610, 632, and 640 are operably fixed to a first driven shaft 634, a second driven shaft 636, and a third driven shaft 642, respectively. As an example, the addition of a third set of pumping gears 638, 640 can provide for a significant increase in pumping ability (e.g., flow rates and volumes), up to triple the capacity of a single gear pair.

In this implementation, the modular design of the bracket 614, first gear casing 616, second gear casing 620, a first separator plate 618, a second separator plate 644, and the casing head 622, allows for modular addition of the gear sets. For example, as illustrated, the bracket 614 may be the same design/type (or same) bracket 114, 214 found in the example pumps 100, 200 of FIGS. 1 and 2. Further, the first gear casing 616 and second gear casing 620 may be the same design/type (or same) gear casings 116, 216, and 220 found in the example pumps 100 and 200. In this example, in this modular design, the second separator plate 644, the third gear casing 638, and casing head 622 can be fixedly engaged with the bracket 614, first gear casing 616, first separator plate 618, and second gear casing 620, of the same design to create the new, triple gear pump 600.

In this example, a bearing housing 604 can comprise a bearing assembly 624, which may help stabilize the driver shaft 602, by mitigating axial and radial movement. In this implementation, the driver shaft is longer than that of the single gear pair, and double gear pair pumps 100, 200. The bearing assembly, in combination with the tight tolerance and clearances between the driver shaft 602 and the driver shaft cavity 658 (e.g., cavity in the bracket 614, first gear casing 616, first separator plate 618, second gear casing 620, second separator plate 644, third gear casing 646, and casing head 622) in the pump housing 650, helps mitigate the effects of axial and radial movement or force applied to the shaft 602 under load. This allows for more efficient pumping, and less wear on the parts of the pump. Additionally, a seal 606 may be engaged with the shaft 602 at a location where the shaft 602 enters the pump housing 650. The seal can mitigate leakage of a pumped fluid from inside the pump (e.g., along the driver shaft cavity 658) to the outside of the pump 600.

In this implementation, the first separator plate 618 of the example pump 600 can comprise a first port 612*a* and a second port 612*b*. The first port 612*a* and second port 612*b* are in fluid communication with the first gear casing 616, the second gear casing 620, and the third gear casing 646, such that fluid pumped by the respective gears 608, 610, 630, 632, 638, 640 inside the respective gear casing 616, 620, 646 may be drawn in through one of the ports and out of the other port, depending on the orientation of the pump. That is, for example, the first port 612*a* can comprise an outlet or discharge port, and the second port 612*b* can comprise an inlet or suction port, such as when the pump is oriented in a clockwise (CW) orientation. Further, for example, the first port 612*a* can comprise the inlet or suction port, and the second port 612*b* can comprise outlet or discharge port, such as when the pump is oriented in a counter-clockwise (CCW) orientation.

As described above for the casing head 122 in FIG. 1 and separator plate 218 on FIG. 2, in one implementation, the separator plate 618 may comprise a modular design that allows it to be rotated one-hundred and eighty degrees around its central axis to provide appropriate CW and CCW markings for the installer of the pump. These markings allow the installer to readily view on which side the suction and discharge ports are disposed, based on the CW or CCW orientation of the pump. In one implementation, the second separator plate con comprise the first port 612*a* and the second port 612*b*. In this implementation, the first separator plate may not comprise any ports.

Further, the pump housing 650 can comprise a first pump chamber (not illustrated) that is fluidly coupled with the first port 612*a*, and a second pump chamber (not illustrated) that is fluidly coupled with the second port 612*b*. In one implementation, the first pump chamber can be fluidly coupled with discharge side of the respective gear casings 616, 620, 646; further, the second pump chamber can be fluidly coupled with the suction side of the respective gear casings 616, 620, 646. In this way, in one example, fluid can be drawn in through the second port, into the second chamber, through the respective gear casings 616, 620, 646, through the gears, into the first pump chamber, and out the discharge port 612*a*.

Additionally, the example, pump 600 can comprise a bracket foot 626 and a casing foot 628. The bracket foot 626 can be part of or fixed to the bracket 614; and the casing foot 628 can be fixed to or part of the casing head 622. In this implementation, the bracket foot 626 and casing foot 628 can be used to fasten the pump 600 to a stationary platform, such as at the location where pumping of the product is desired. That is, for example, the respective feet 626, 628 can comprise fastening vias that allow a fastener to pass through to fasten to the stationary platform, in order to hold the pump 600 to the platform.

In one implementation, a Lease Automatic Custody Transfer ("LACT") system can be devised to transfer custody of a petroleum product from a collection site (e.g., a landowner's site of oil production/collection) to a pipeline used to transport the petroleum product, through or from a metering apparatus used to meter the flow of the product. For example, a LACT pump system as described herein can be used to push the product against high pressures into the pipeline. That is, in this example, a pipeline that transports crude oil can be under high pressure due to the type and amount of product being transported, and the length of the pipeline to a destination (e.g., collection point). Therefore, in this example, the LACT pump may need to push the product at higher pressures to inject it into the transport pipeline effectively.

FIGS. 7-11 are component diagrams illustrating several example implementations of LACT pumps 700, 800, 900, 1100, which may be used to push product to a transport pipeline. Example pump 700 is a single gear pair, external gear pump in a clockwise (CW) orientation; example, pump 800 is a single gear pair, external gear pump in a counter-clockwise (CCW) orientation; example pump 900 is a double gear pair, external ear pump; and example, pump 1100 is a triple gear pair, external gear pump. In these implementations, the example, pumps are configured with modular parts that can be used to extend the pumps from a single gear pair, to a double and triple gear pair using the same parts. That is, for example, the respective pumps can comprise the same (e.g., of the same design) bracket 714, 814, 914, 1114 in any of the configurations, whether single, double or triple, and CW or CCW. Further, for example, the respective pumps can comprise the same (e.g., of the same design) gear casings 716, 816, 916, 1116 as a first gear casing; and/or the same gear casing 920, 1120, 1146 as the second or third gear casings. Additionally, for example, the respective pumps can comprise the same (e.g., of the same design) separator plates comprising a first and second port 918, 1118. That is, the respective parts may be interchangeable between respective pump designs, and orientations.

In one implementation, as illustrated in FIGS. 7*a*-7*d*, an example pump 700 can comprises a driver shaft 702, and a back pull out seal 706. For example, a back pull-out pump seal design can be configured for rapid dismantling and re-assembly. In this implementation, the pump 700 with the back pull-out seal 706 can be used in petroleum product pumping, such as for process pumps. For example, the advantage of this design is that the rotating assembly, including any bearings and shaft seals (e.g., 706) may be readily pulled out of the pump housing 750. In this example, this configuration allows internal components to be inspected and replaced without having to remove the casing from the piping or platform.

Further, in this implementation, the example pump 700 can comprise the driver gear 708, and a driven gear 710. In this implementation, the driver gear 706 can comprise a gear that is fixedly engaged with (e.g., press or friction fit, fastened, glued, welded, soldered, or otherwise attached to, or formed with, or fastened with a fastener or clip to) the shaft 702, such that when the shaft rotates the driver gear 706 rotates (e.g., the shaft applies torque to the driver gear 706). That is, for example, a motor (not pictured) drives the rotation of the shaft 702, which drives the rotation of the gear 706.

In this implementation, the gears 708, 710, and respective gears described herein, can comprise an improved material construction that provides for improved operation, less maintenance, longer operational life, and lower overall cost. For example, the improved materials can comprise harder gears and gear teeth, such as hardened steel, steel alloys, and other metals that resist abrasion and other damage. In one implementation, one or more components of the respective pumps described herein can be Vitek hardened to increase wear resistance. Further, the pump parts, including the gears, gear teeth, heads, casings, drive shaft, seal, bearings, and bushings can be formed with tighter tolerances and clearance (e.g., gaps) than previously found in these types of pumps. The improved tolerances can help provide improved pressure ratings, a smaller footprint, and improved overall operational life.

Additionally, the example pump 700 can comprise one or more ports 712, for example, with one or more bolt attachment components. The pump 700 can comprise a first port 712*a* and a second port 712*b*. For example, the first port 712*a* may be an outlet or discharge port, and the second port 712*b* may be an inlet port, when the pump 700 is disposed in a CW orientation. As illustrated in FIGS. 8A-8*d*, the example, pump 800 can comprise a first port 812*a* and a second port 12*b*. For example, the first port 812*a* may be an inlet or suction port, and the second port 712*b* may be an outlet or discharge port, when the pump 800 is disposed in a CCW orientation The example pump 700 can also comprise a gear casing the bracket 714, a gear casing 716, and a head casing 722. Further, as illustrated in FIGS. 7-11 the various implementations of the LACT pump comprise merely one mechanical seal 706, 806, 906, 1106, with the opposing end of the driver shaft 702, 802, 902, 1102 contained internally to the pump housing 750, 850, 950, 1150. This type of arrangement can help reduce abrasive wear and mitigate leakage. Further, in these examples, a suck back system can be implemented, that is vented to the inlet side or suction side of the pump. Additionally, in these examples, one or more thrust bearing components can be implemented in higher-pressure situations.

In these examples, the innovative bracket 714, 814, 914, 1114 can be used to hold the seal 706, 806, 906, 1106, and provide for shaft support in order to mitigate axial and radial movement when forces are applied to the shaft under load. Further, for example, the same bracket 714, 814, 914, 1114 can be utilized while a different seal may be introduced for various gear types and numbers of gears. Additionally, for example, utilizing this innovative bracket design, additional gear sections can be stacked (e.g., 900 if FIG. 9, 1100 in FIG. 11) with a longer drive shaft to add more bearings to support the shaft and reduce pressure on the bearings. In this implementation, this allows additional gear sections to be added to increase flow pressure and/or flow rate, without increasing the size (e.g., diameter) of the pump, which would occur in an existing system that merely increase the gear size. This design allows for maintaining substantially constant pressure and flow rates.

In some examples, the innovative head and separation plate design allows the casings to be rotated without changing the heads or separation plates. For example, this allows a user to rotate the casing to provide for either CW or CCW rotation in the same pump. In some implementations, visual indicators (e.g., markings such as stamping, labels, etc.) may be provided to allow the user to set up the pump in the desired CW or CCW rotation. Further, this innovative design allows the designer of the pump installation to place the pump system in an appropriate position for the site situation. For example, the user can merely disassemble the pump and set the configuration that is appropriate for the situation, without needing to replace additional parts in the pump.

Figure 10:
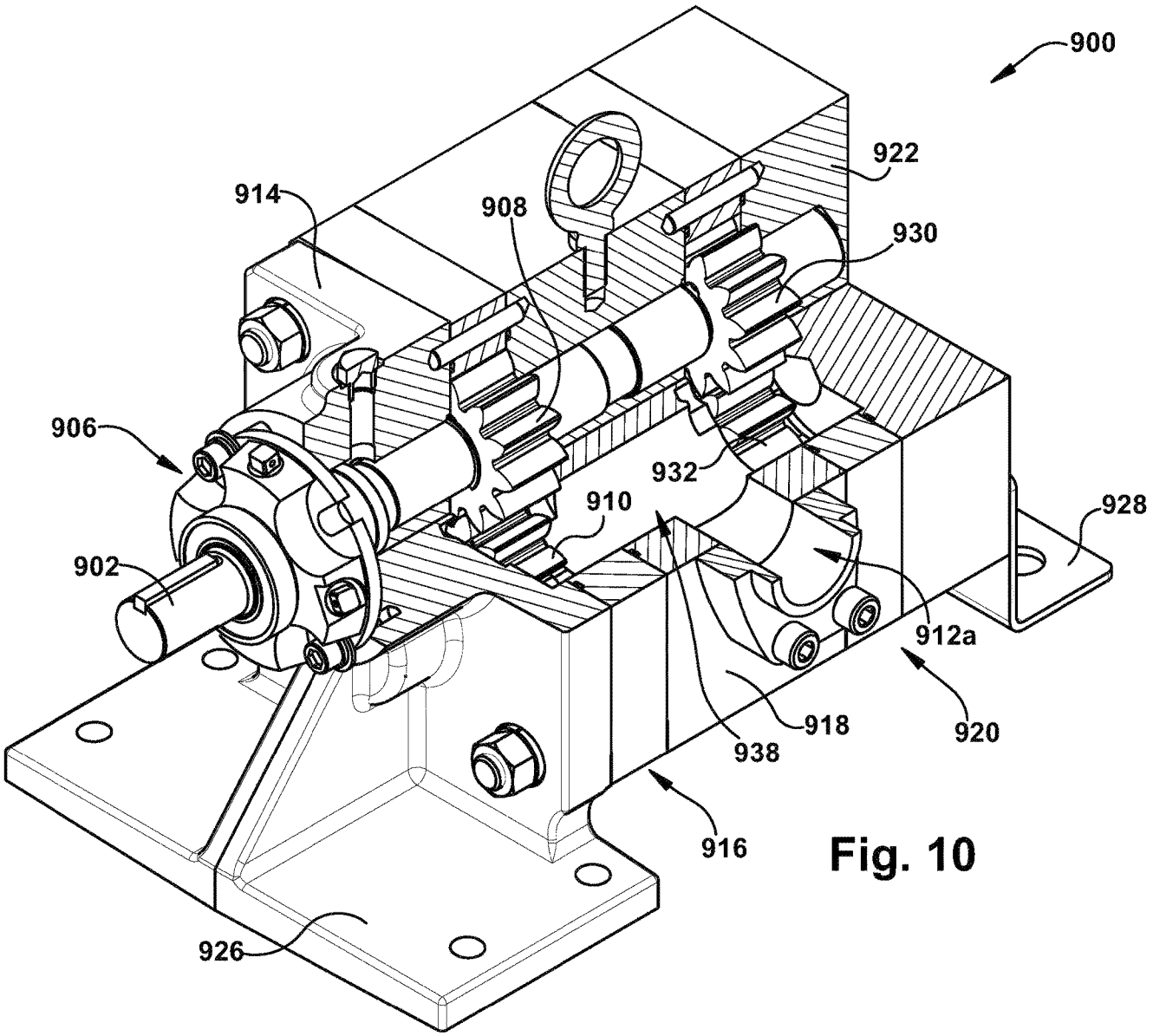
FIG. 10 is a component diagram illustrating an example implementation of one or more portions of one or more systems described herein.
Figure 11B:
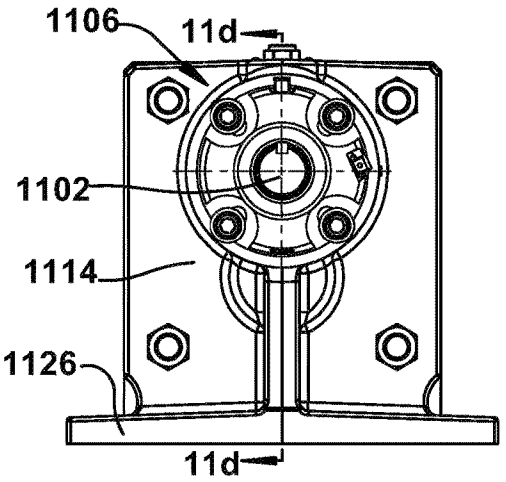
FIGS. 11*a*, 11*b*, 11*c*, and 11*d* are component diagram illustrating various view of yet another implementation of an example external gear pump that may be used for LACT purposes.
Figure 11A:
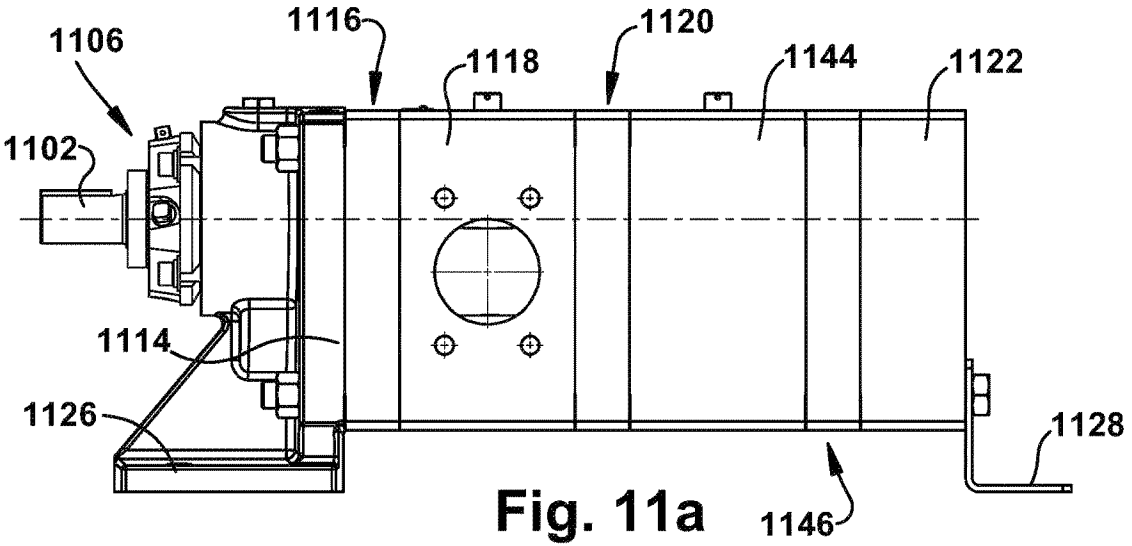
Figure 11C:
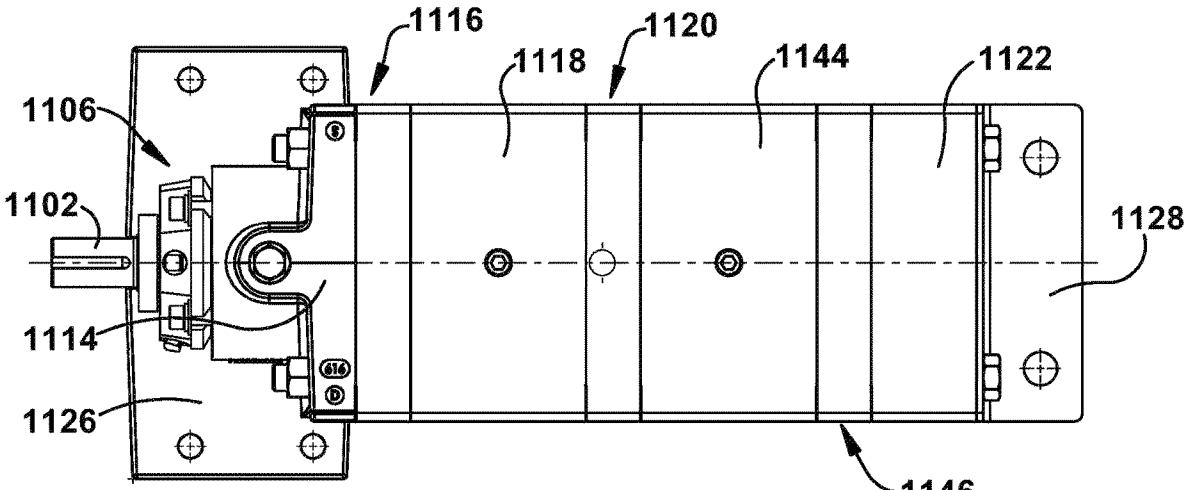
Figure 11D:
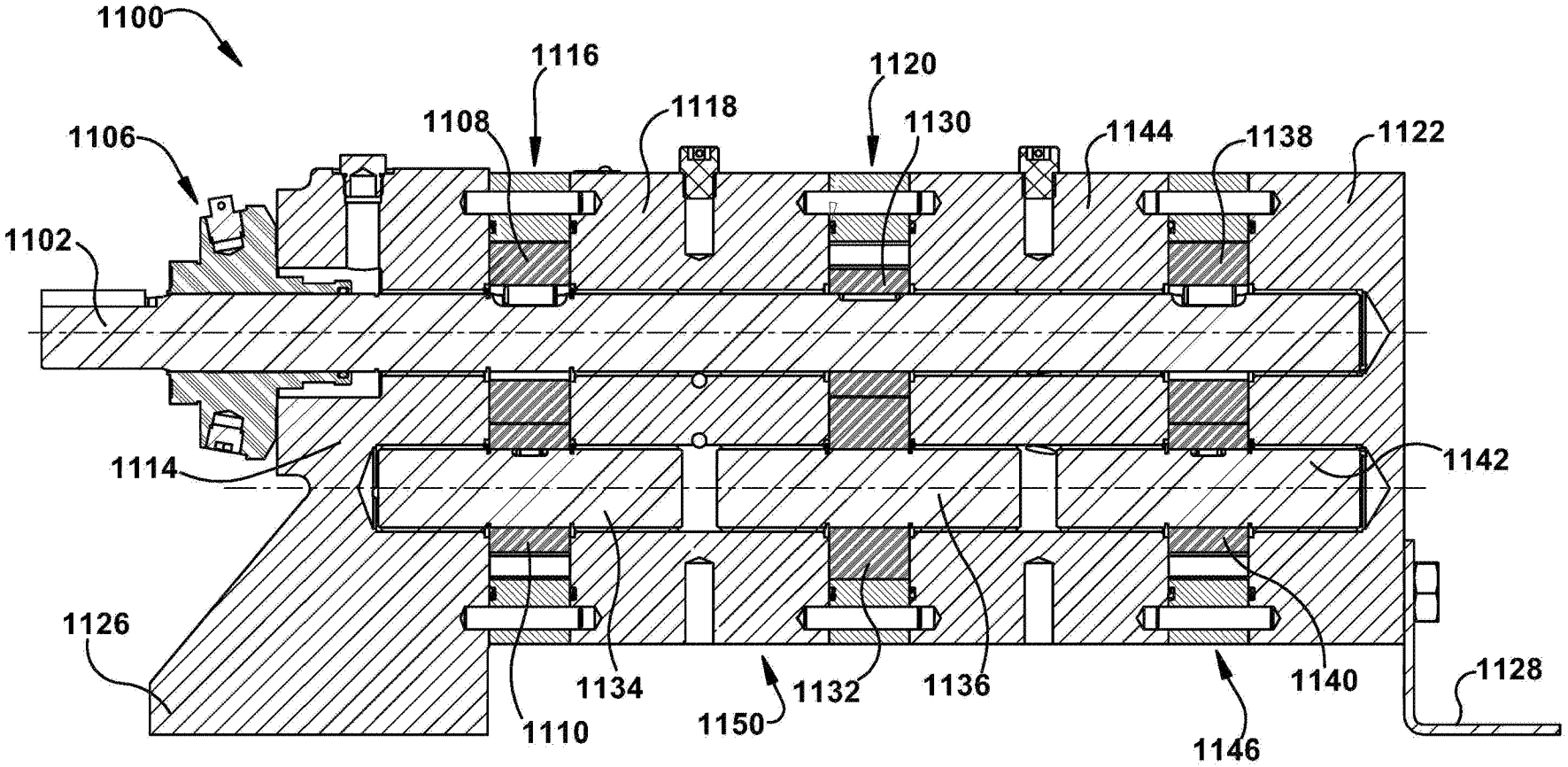

As illustrated in FIGS. 7-11, the respective pumps 700, 800, 900, 1100 can comprise the pump housing 750, 850, 950, 1150, respectively comprising at least a bracket 714, 814, 914, 1114, and a casing head 722, 822, 922, 1122. In the single gear pair pumps 700, 800, the pump housing 750, 850 comprises the first port 712*a*, 812*a*, and second port 712*b*, 712*b*, and a first pumping chamber and second pumping chamber inside the housing (not shown). The double gear pump 950 further comprises a second gear casing 920 with the first gear casing 916, and a separation plate 918. In this implementation, as illustrated in FIG. 10, the separator plate 918 comprises the first pumping chamber 938, and a second pumping chamber (not shown) disposed on the opposite side of the separator plate. Further, the head casing 922 merely comprises a cavity to hold the driver shaft 902. The first and second ports 912*a*, 912*b* are in fluid communication respectively with the first 938 and second pumping chambers; and are in fluid communication with the internal chamber of the gear casings 916, 920. In this way, the rotation of the gears provides for fluid to be drawn into the inlet port (e.g., 912*b*) through the second pumping chamber, the gear casings 916, 920, into the first pumping chamber 938, to the outlet port (e.g., 912*a*).

As illustrated in FIG. 11, the triple gear pump 1100 also comprises a third gear casing 1146, along with the first and second gear casings 1116, 1120. Further, the pump 1100 comprises a second separator plate 1144, along with the first separator plate 1118. In this implementation, the first separator plate comprises the first and second ports 1112*a*, 1112*b*. As an example, the head casing 1122 can be of the same design (e.g., or the same) as the casing 922 of FIG. 9. Additionally, respective pumps 700, 800, 900, 1100 can comprise a bracket foot 726, 826, 926, 1126, which can be used to secure the pump to a platform or location. Further, pumps 900 and 1100 can comprise a casing foot 928, 1128, which can also be used to secure the pump to a platform or location.

Particular environments may offer challenges to conventional external gear pumps. For example, in hydraulic fracturing or "fracking" processes a proppant, such as sand, can be used to maintain the fractures in the rock allowing them to extract hydrocarbons from the ground. In this example, the sand may become entrained in the resulting extracted hydrocarbons, which can end up in the pump used to extract or transfer the hydrocarbons. In order to pump this liquid at high pressures, such as 1500 psi, the pump typically uses tight clearances to provide flow. As an example the entrained sand may result in wear related damage to the internal pump parts, shortening the life of these pumps.

In one aspect, an innovative external gear pump, as described herein, may be devised to mitigate wear related damage, improve flow, improve the operational life of the pump, and provide for easier and cost effective maintenance of the pump when needed. For example external gear pumps 100, 200, 300, 600, 700, 800, 900, 1100, and 1200, may be further configured to enable improved wear protection, for example in environments susceptible to high abrasion. Various implementations describe herein can comprise innovative enhancements that may be used alone or combination.

Figure 12A:
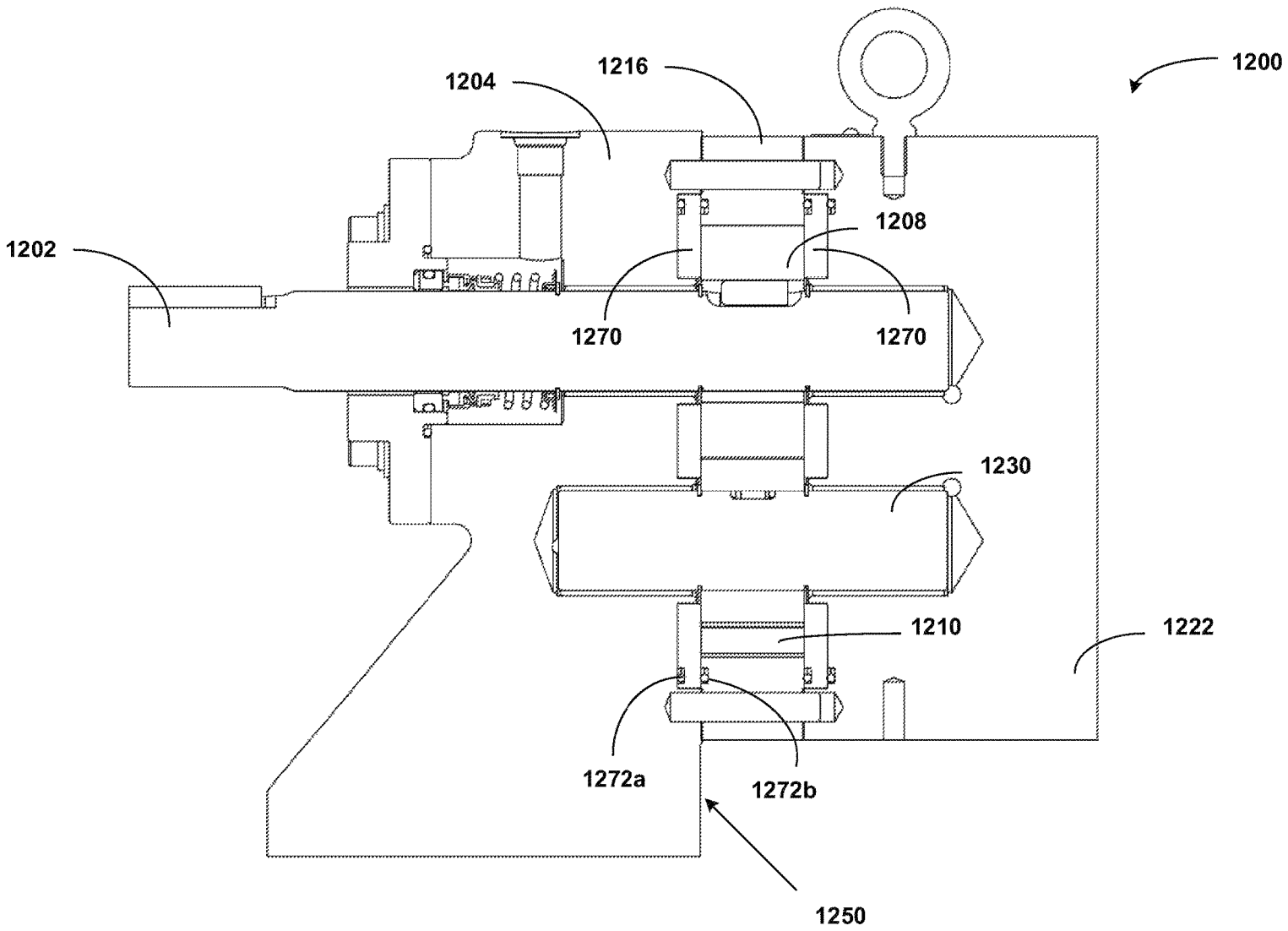
FIGS. 12A and 12B are component diagrams illustrating various views of yet another implementation of an example external gear pump.
Figure 12B:
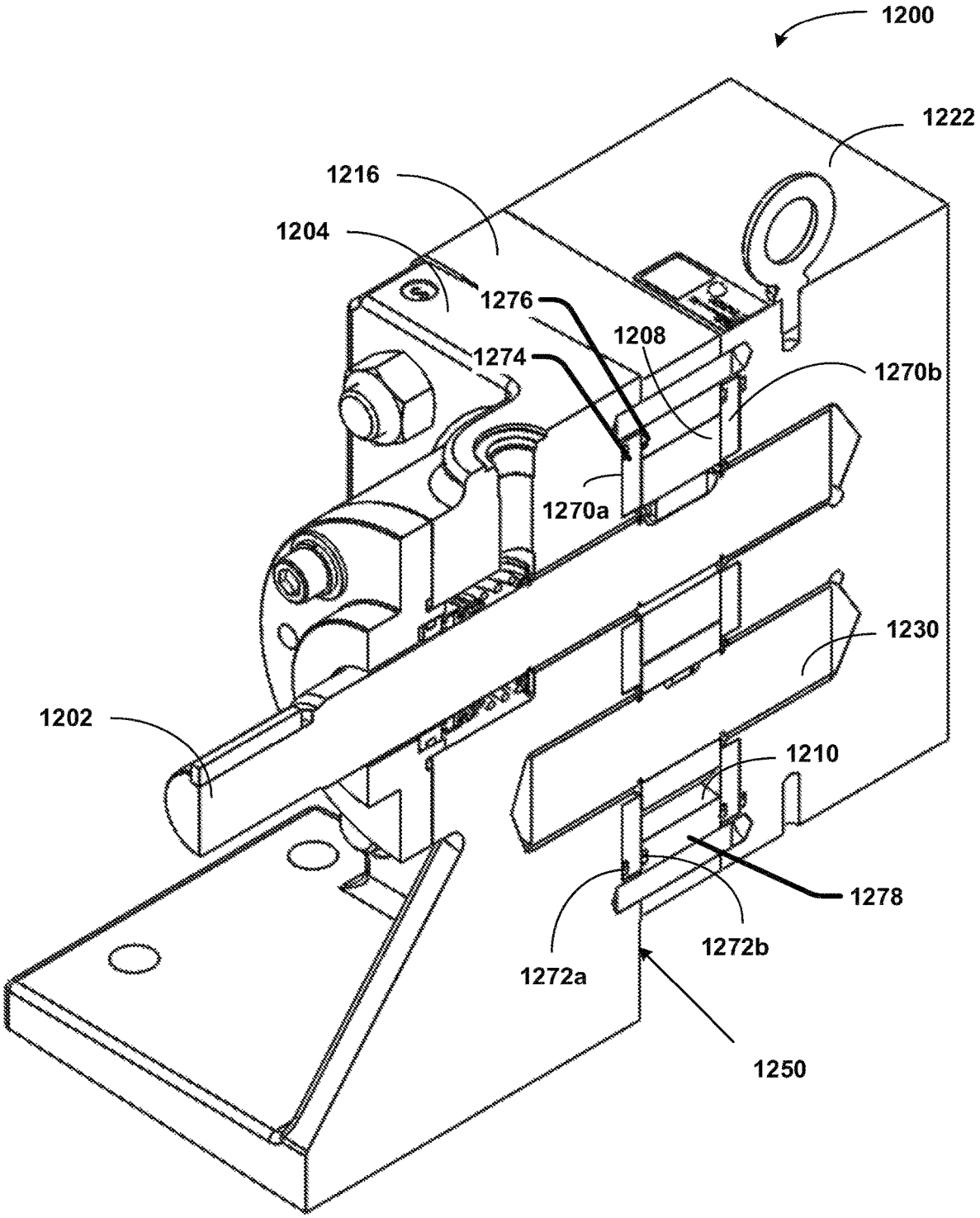

In an example implementation, illustrated in FIGS. 12*a* and 12*b*, wear plates/blocks or fixed end plates/blocks may be used to increase the life of the external gear pumps described earlier as well as providing for ease of maintenance and repair. For example, the end plates/blocks may be provided in a repair kit that allows the pump to be repaired instead of replacing the pump with new housing components, which are likely to be more costly. Further, as an example, the bearings used for shaft support in the external gear pumps described earlier may also be damaged by the abrasives or the resulting failure from the abrasives. In some implementations, bushings can be disposed between the driven shaft and/or driver shaft and an end block to help improve maintenance and improve the life of the internal components of the pump.

FIGS. 12A and 12B illustrate one example of an external gear pump 1200. FIG. 12A illustrates a sectional view of external gear pump 1200, while FIG. 12B illustrates an isometric view of the external gear pump 1200. External gear pump 1200 comprises a single gear pair combination. Although a single gear pair combination is shown, two gear pairs, or three gear pairs, or even more gear pairs may be used.

In this example implementation, external gear pump 1200 also includes a driver shaft 1202 (e.g., aka drive shaft), which may be coupled with a motor during operation (operably coupled), to provide rotational power to the driver shaft 1202. Further, operably, fixedly engaged with the driver shaft 1202 is a driver gear 1208. Rotation of the driver shaft 1202, such as by an operably coupled motor, results in rotation of the driver gear 1208. External gear pump 1200 may also include a driven gear 1210, which, during operation, is meshedly engaged with driver gear 1208. That is, for example, as driver gear 1208 rotates, due to rotation of the driver shaft 1202, and that rotation, along with the meshed engagement with the driven gear 1210, results in rotation of the driven gear 1210 (e.g., in the opposite direction of the driver gear 1208).

Additionally, the driven gear 1210 is operably, fixedly engaged with a driven shaft 1230, which rotates substantially freely inside the housing 1250 of the external gear pump 1200. External gear pump 1200 may also include a bracket 1204, a gear casing 1216, and a casing head 1222. In this implementation, the bracket 1204, gear casing 1216, and the casing head 1222 form the housing 1250 of external gear pump 1200.

As illustrated in FIGS. 12A and 12B, the example external gear pump 1200 may further include at least one replaceable fixed end plate (e.g., a wear plate or clock) disposed adjacent to respective sides of the driver and/or driven gears 1208, 1210. As illustrated in FIGS. 12A and 12B, two fixed end plates 1270 are disposed on either side of the driver gears 1208 and driven gears 1210. In some implementations, fixed end plates 1270 may be constructed with or coated with abrasive resistant material that extends the life of the external gear pump 1200. Such material will also reduce the friction between surfaces and improve the life of the external gear pump under poor feeding conditions.

For example, fixed end plates 1270 may be constructed or coated with Through Hardened 4140 Steel; Austenized 4140 Steel; Diamond Like Coating 4140 Steel; Electroless Nickel Plated 4140 Steel; Ti/AL nitrided 4140 Steel; Marquenched 25100 Steel; Ductile Iron; Austempered Ductile Iron; Anodized Aluminum with PTFE; Tungsten Carbide; Duplex Stainless Steel; Chrome White Cast Iron; Electroless Nickel Plated Ductile Iron; Armoloy XADC or TDC Coated Ductile Iron; Diamond-Like Carbon (DLC) Coated Ductile Iron; Diamond-Like Carbon (DLC) Coated gray iron. In addition, fixed end plates 1270 may be made up of a combination of these materials to extend the life of the pump before repair or replacement. A TEFLON® coating may also be used in conjunction with these materials.

Figure 13C:
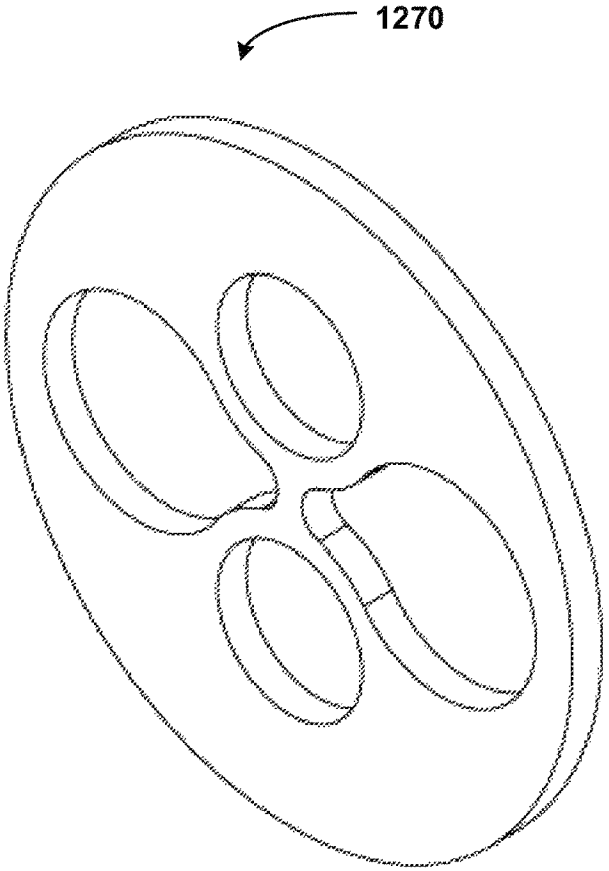
FIGS. 13A, 13B, 13C and 13*d* are component diagrams illustrating various views of an implementation of an example edge plate that may be used in an external gear pump.
Figure 13B:
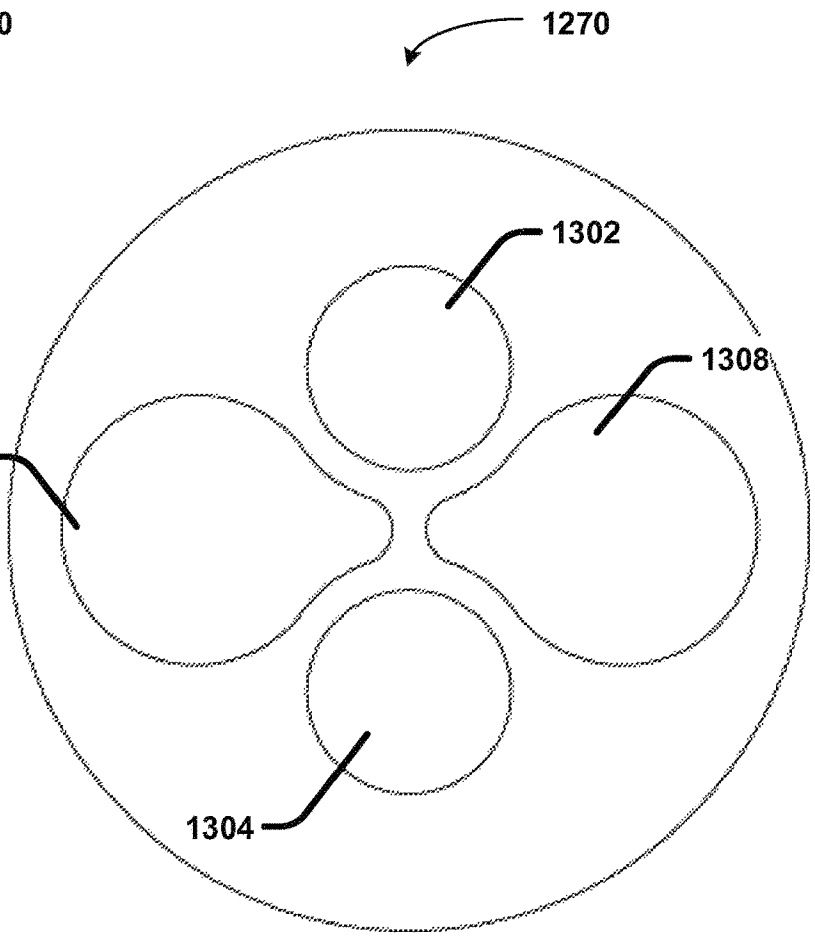
Figure 13A:
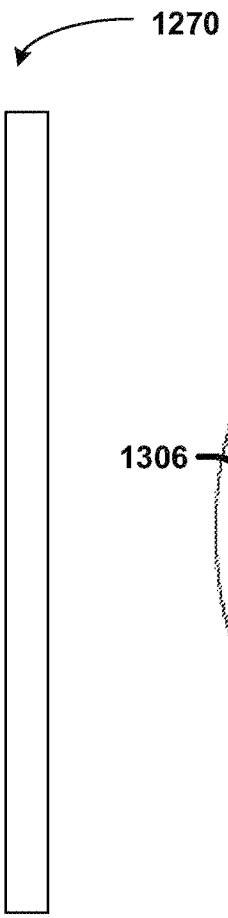
Figure 13D:
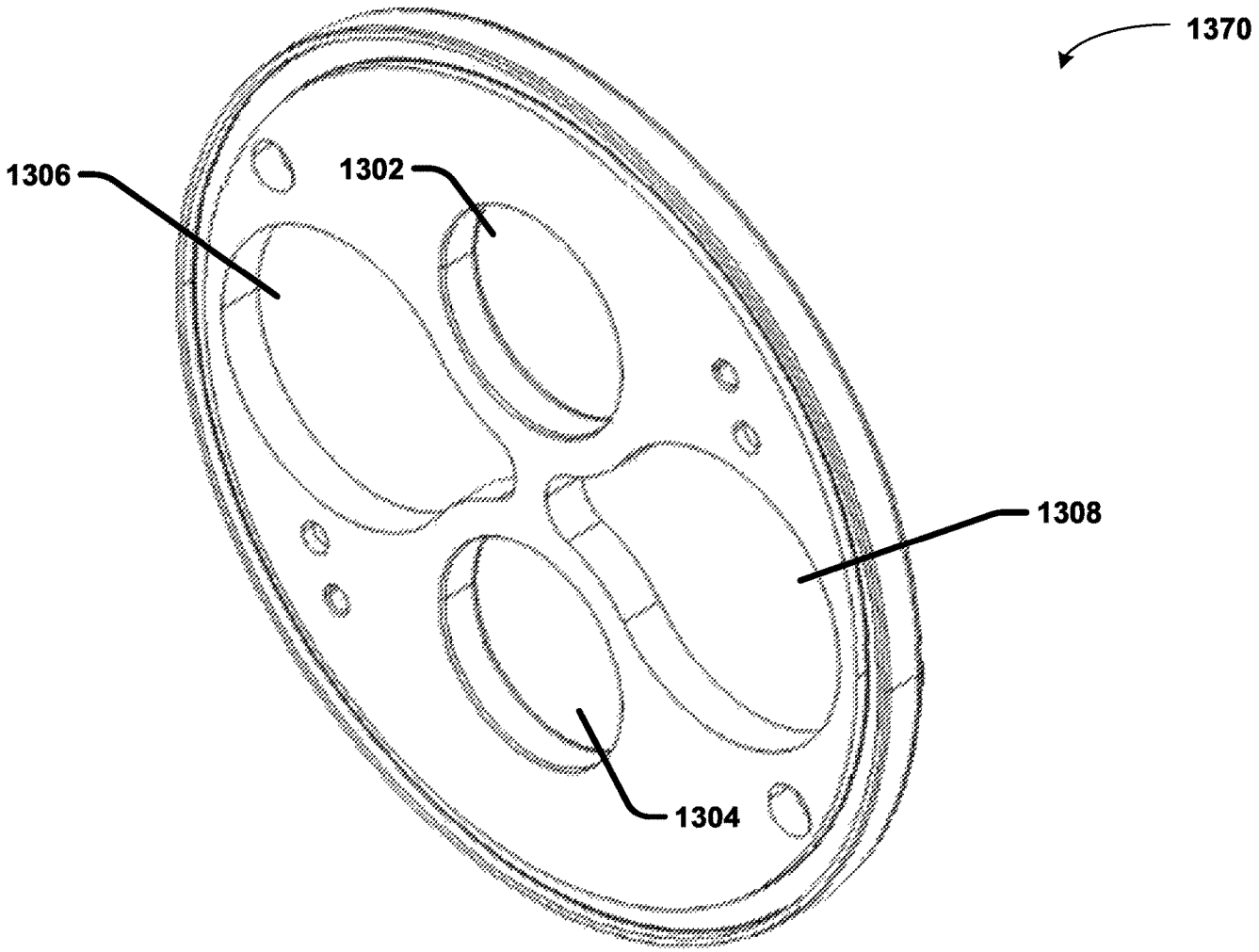

FIGS. 13A, 13B and 13C illustrate a component side view, front view, and perspective view, respectively, of one implementation of an example fixed end plate 1270 and FIG. 13*d* illustrates an alternate implementation of an example, fixed end plate 1370. In this implementation, the end plate 1270 can comprise a top passage 1302 and bottom passage 1304. The top passage 1302 can allow the driver shaft 1202 to pass through, and the bottom passage 1304 can allow the driven shaft 1230 to pass through. Further, in this implementation, the end plate 1270 can comprise a left passage 1306 and a right passage 1308. The left passage can fluidly couple with the pump's first port (e.g., 112*a*), and the right passage can fluidly couple with the pump's second port (e.g., 112*b*).

As illustrated in FIGS. 12A and 12B, a fixed end plate 1270 may be arranged on either side of driver gear 1208 and driven gear 1210. That is driver gear 1208 and driven gear 1210 may be sandwiched between left and right fixed end plates 1270 when held together within the housing 1250. Further, in this implementation, a gasket channel 1274 can be disposed in the face of the respective end plates 1270 to receive and operably hold gaskets (e.g., O-rings) 1272*a*; and, in some implementations, a gasket channel 1276 can be disposed in the face of a gear block 1278, to receive and operably hold gasket 1272*b*. The respective gaskets 1272 may also be utilized as seals to respective end plates 1270 (e.g., left and right fixed end plates 1270). That is, for example, end plate 1270 and gaskets 1272*a* and/or 1272*b* can act together as part of the housing to provide a seal to mitigate passage of internal liquid to the exterior of the external gear pump 1200.

In some implementations, fixed end plates 1270 can also be configured to allow for improved ease of insertion and removal into the housing 1250 of the external gear pump 1200. That is, for example, the bracket 1204, gear casing 1216, and casing head 1222 can be separated from each other, and the respective gear end plates 1270 may be removed and replaced.

Additionally, respective fixed end plates 1270 may be configured to be swappable with each other in the pump housing. For example, a left fixed end plate 1270*a* may be swapped with a right fixed end plate 1270*b*. As a result of such swapping, the left side of the left plate 1270*a* will now be exposed to the gears 1208, 1210, and the right side of the right plate 1270*b* will now be exposed to the gears 1208, 1210. For example, this swapping exposes the previously unexposed side of each end plate, providing a fresh (e.g., and unworn) surface toward the gears 1208, 1210. That is, for example, the fixed end plate 1270 may be used interchangeably on either side of the external gears allowing use on a first side of the fixed end plate 1270 (e.g., a left side) exposing a first side of the fixed end plate 1270 to the abrasive material, followed by use of a second side of the fixed end plate (e.g., a right side) exposing the previously unexposed side to the abrasive material. This allows each fixed end plate 1270 to be used twice before potential replacement, thereby further extending the life of the parts of the external gear pump 1200.

As one example, the fixed end plate 1270 may act as a wear component that can degrade to a point where the external gear pump 1200 may no longer able to deliver the desired performance (e.g., pumping pressure and/or volume rate). In this example, the fixed end plate 1270 may be replaced to restore the performance of the external gear pump 1200. In some implementations, the fixed end plates 1270 are configured such that they may be swapped with each other to allow a second use of the plates, effectively doubling their operable life before replacement may be performed. This feature also provides the utility of alternative materials such as those outlined above.

In an alternative embodiment of external gear pump 1200, fixed end plate 1270 may be a pressure balanced. A pressure balanced version of fixed end plate 1270 may be constructed to a tighter tolerance than that of a non-pressure balanced version. That is, for example, a pressure balanced end plate may be a wear component that will be able to maintain tight clearances between the end plate 1270 and the gears 1208, 1210 by the means of hydraulic pressure balancing. For example, discharge pressure provided by the pump system is promoted to the backside of the end plate, which that can cause it to be biased toward the gears. In this example, as the end plate wears, the biasing force acting on the plate can maintain the desired end clearance between the gear and end plate.

As an example, the higher tolerances may result in a pressure balanced version of the fixed end plate being unsuitable for the aforementioned swapping to expose a previously unused side. However, in exchange for such lack of side-to-side swapping capability, the higher tolerances may offer increased operation performance, and may provide protection due to less exposure of unprotected areas. Both the non-pressure balanced and a pressure-balanced end plate 1270 can offer advantages over the conventional state of the art. Flexibility in selection of such end plates is an advantageous feature of an external pump 1200, in which an end user may customize the external pump 1200 to the situational environment of use.

Figure 14A:
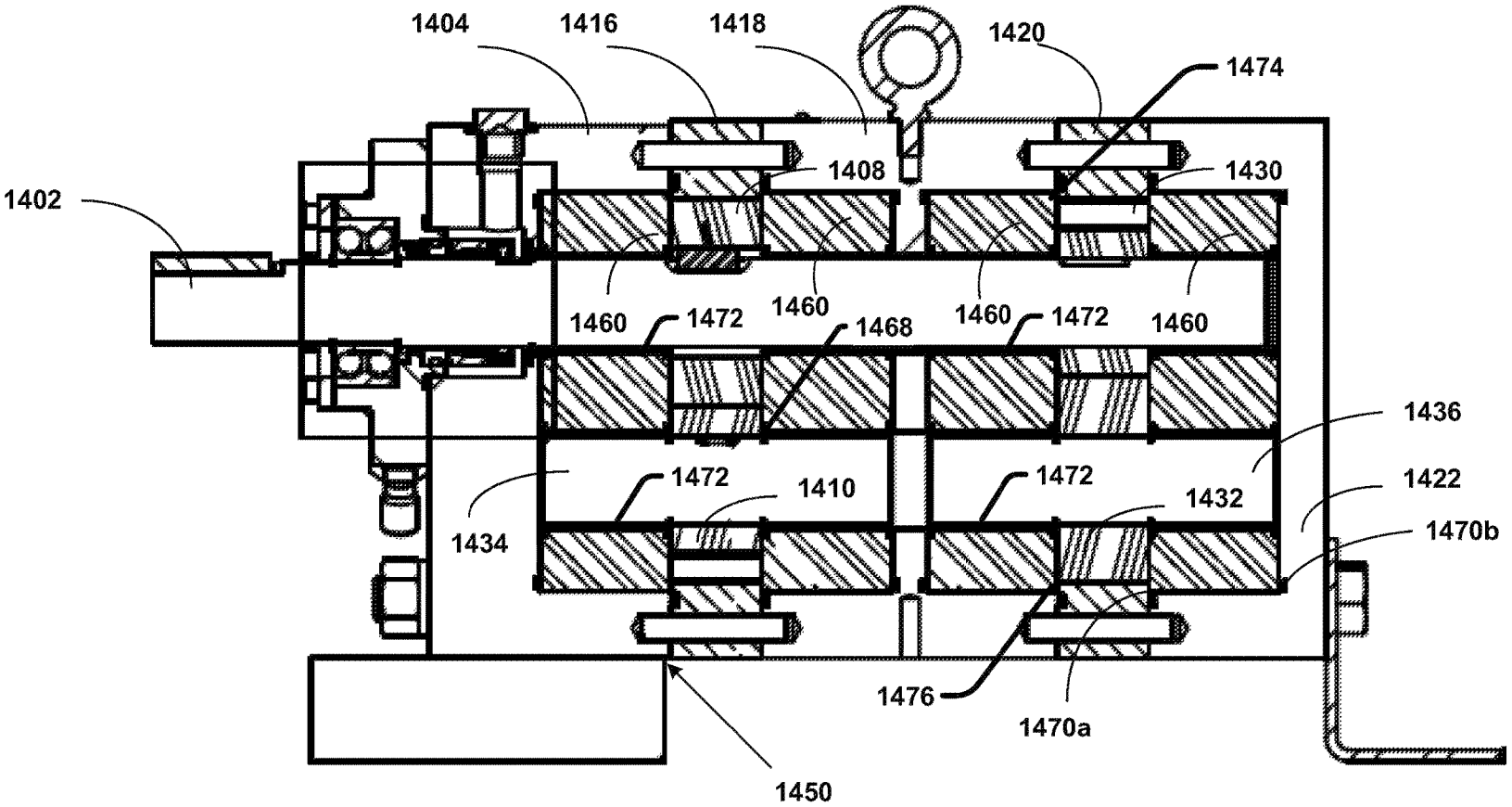
FIGS. 14A and 14B are component diagrams illustrating various views of yet another implementation of an example external gear pump.
Figure 14B:
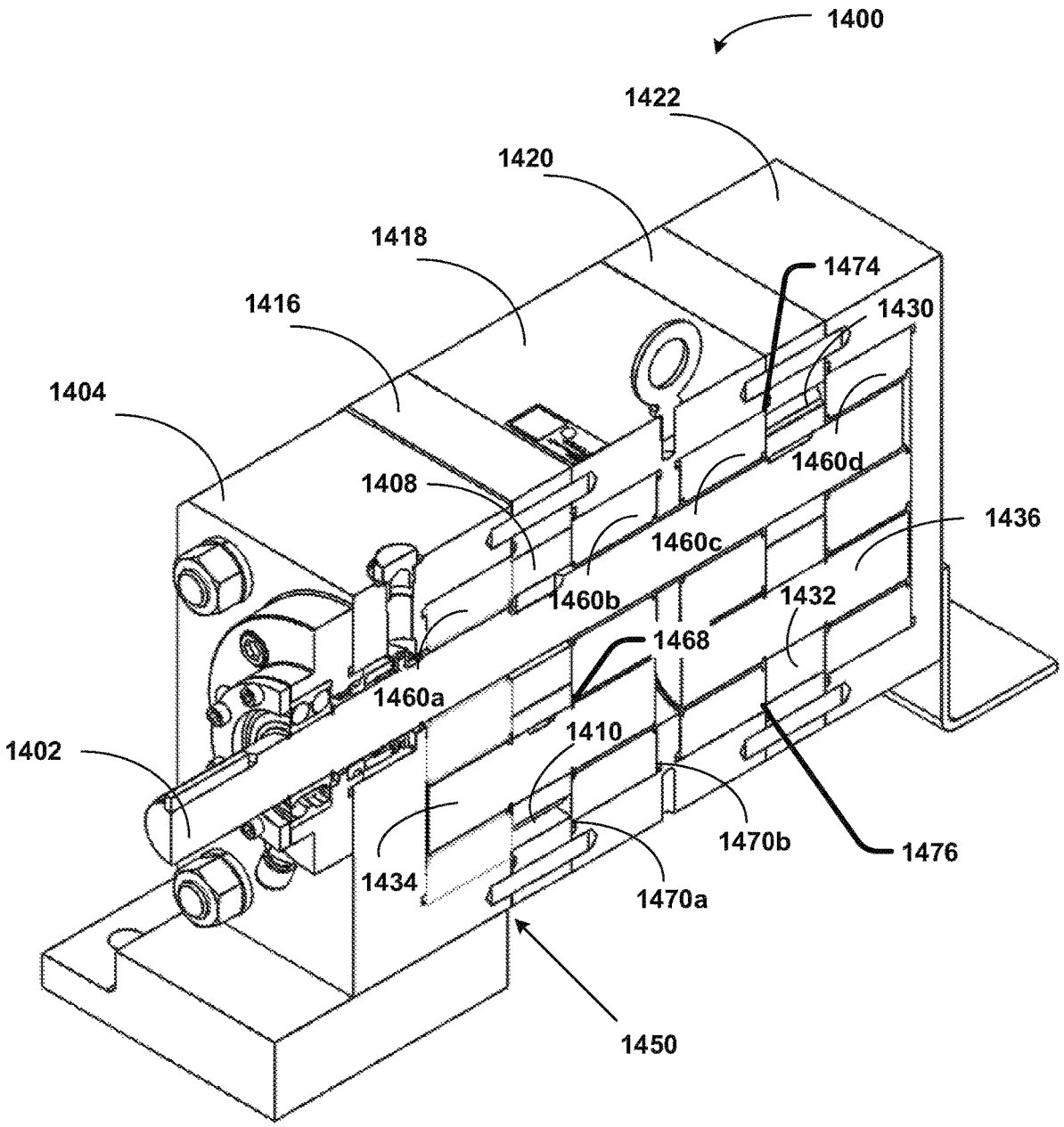

FIGS. 14A and 14B illustrate yet another embodiment of an innovative external gear pump 1400. FIG. 14A shows a sectional view of external gear pump 1400, while FIG. 14B shows an isometric view of the external gear pump 1400. In this implementation, the external gear pump 1400 comprises a double gear pair combination. Although a double gear pair combination is illustrated in external gear pump 1400, a single gear pair combination is also anticipated. Alternatively, gear pair combinations with three or more gear pair combinations may also be used.

As illustrated, external gear pump 1400 includes a first driver gear 1408 and a second driver gear 1430 along with first driven gear 1410 and second driven gear 1432, respectively. First driver gear 1408 and second driver gear 1430 are operably fixed to driver shaft 1402. First driven gear 1410 is fixedly engaged with first driven shaft 1434 while second driven gear 1432 is fixedly engaged with a second driven shaft 1436. In this implementation, the modular design of the bracket 1404, first gear casing 1416, second gear casing 1420, separator plate 1418, and casing head 1422, allow for modular addition or removal of gear sets. In this example, bracket 1404, first gear casing 1416, second gear casing 1420, separator plate 1418, and casing head 1422 form the housing 1450 of external gear pump 1400.

In this example implementation, external gear pump 1400 can comprise at least one replaceable bearing or bushing block 1460. As illustrated in FIGS. 14*a* and 14*b*, four bearing blocks 1460 are shown. Bearing blocks 1460 may be constructed with or coated with abrasive resistant material that extends the life of the external gear pump 1400. Such material will also reduce the friction between surfaces and improve the life of the external gear pump under poor feeding conditions.

For example, bearing blocks 1460 may be constructed or coated with Through Hardened 4140 Steel; Austenized 4140 Steel; Diamond Like Coating 4140 Steel; Electroless Nickel Plated 4140 Steel; Ti/AL nitrided 4140 Steel; Marquenched 25100 Steel; Ductile Iron; Austempered Ductile Iron; Anodized Aluminum with PTFE; Tungsten Carbide; Duplex Stainless Steel; Chrome White Cast Iron; Electroless Nickel Plated Ductile Iron; Armoloy XADC or TDC Coated Ductile Iron; Diamond-Like Carbon (DLC) Coated Ductile Iron; Diamond-Like Carbon (DLC) Coated gray iron DU (PTFE-Impregnated Bronze with Steel Reinforcement); Silicon Carbide; Anodized Aluminum with PTFE; and VESPEL®. In addition, bushings 1460 may be made up of a combination of these materials to extend the life of the pump before repair or replacement. A TEFLON® coating may also be used in conjunction with these materials.

Figure 15B:
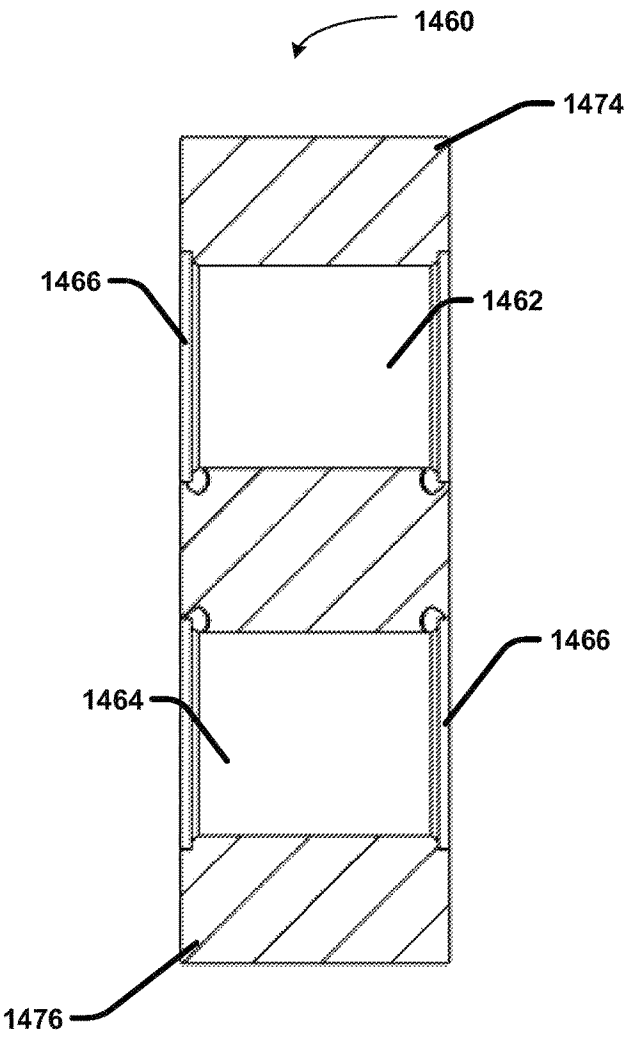
FIGS. 15A and 15B are component diagrams illustrating various views of an implementation of an example bearing block that may be used in an external gear pump.
Figure 15A:
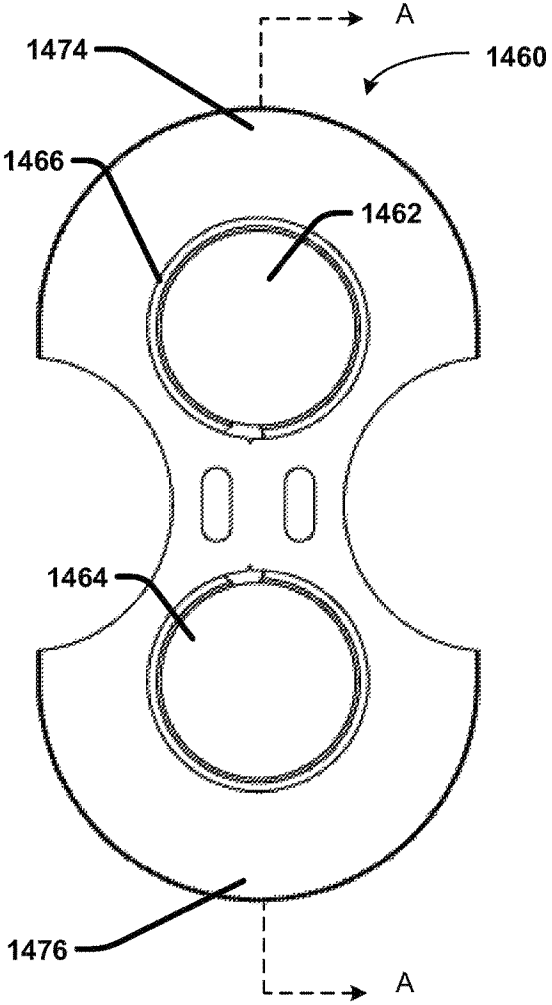

FIGS. 15A and 5B are component diagrams illustrating a component front view, and a cross-sectional side view, respectively, of one example of a bearing block 1460. With continued reference to FIGS. 14A and 14B, the cross-sectional side view of FIG. 15B correlates to line A-A of FIG. 15A. In this example, the bearing block 1460 comprises a top passage 1462 and a bottom passage 1464. For example, the top passage 1462 can be configured to receive the driver shaft 1402, and the bottom passage 1464 can be configured to receive a driven shaft 1434, 1436. Further, the bearing block 1460 can comprise a recess, shoulder or annular shaped step 1466 proximate the opening of respective passages 1462, 1464. In one implementation, the recess 1466 can comprise a groove that is configured to receive, and operably hold, a gasket 1468 (e.g., O-ring). The gasket 1468 may be used to mitigate leakage of pumped from inside the pumping chamber to the outside (e.g., outside the pump or into the environment).

As can be seen from FIGS. 14A and 14B, bearing blocks 1460 may be arranged on either side of driver gear 1408 and driven gear 1410, and also on either side of driver gear 1430 and driven gear 1432. That is, for example, both driver gear 1408 and driven gear 1410 and driver gear 1430 and driven gear 1432 may each be sandwiched between left and right bearing blocks 1460 when held together within the housing 1450.

In some implementations, the bearing blocks 1460 can be configured to facilitate easy insertion into and removal from the housing 1450 of the external gear pump 1400. For example, the bracket 1404, first gear casing 1416, separator plate 1418, second gear casing 1420, and casing head 1422 can be separated from each other, and the bearing blocks 1460 may be removed and replaced.

In one implementation, gaskets 1470*a* and 1470*b* (e.g., O-rings) can be disposed in the gear pump 1400, at the gear casing block 1416. In this implementation, respective gaskets 1470*a* and/or 1470*b* may also be utilized as seals to mitigate leakage of process fluid from the pumping chamber, providing a seal for the housing for sealing internal liquid to the exterior of the external gear pump 1400. Further, the bearing blocks 1460 may also operably provide support to the respective shafts 1402, 1434 and 1432, to mitigate oscillation of the shafts outside of their respective axes of rotation. Additionally, the bearing blocks 1460 may provide protection to the driver shaft 1402 and driven shafts 1434 and 1432.

In some implementations, the bearing blocks 1460 can be configured to be swappable with each other in the pump housing. For example, a left bearing block 1460*a* of the first gear pair may be swapped with a right bearing block 1460*b* of the first gear pair or right bearing block 1460*d* of the second gear pair (and other equivalent permutations). As a result of such swapping, the left side of the left block 1460*a* will now be exposed to the gears 1408, 1410, and the right side of the right plate 1460*b* will now be exposed to the gears 1408, 1410. For example, this swapping can expose a previously unexposed side of each bearing block 1460, providing a fresh (e.g., and unworn) surface toward the gears 1408, 1410. That is, for example, the bearing block 1460 may be used interchangeably on either side of either of the external gears allowing use on a first side of the bearing block 1460 (e.g., a left side) exposing a first side of the bearing block 1460 to potential wear, such as from abrasive material, followed by use of a second side of the bearing block (e.g., a right side) exposing the previously unexposed side to potential wear. This allows each bearing block 1460 to be used twice before potential replacement, thereby further extending the life of the parts of the external gear pump 1400.

As one example, the bearing blocks 1460 may act as wear components that can degrade to a point where the external gear pump 1400 may no longer able to deliver the desired performance (e.g., pumping pressure and/or volume rate). In this example, the bearing blocks 1460 may be replaced to restore the performance of the external gear pump 1400. In some implementations, the bearing blocks 1460 are configured such that they can be swapped with each other to allow a second use of the blocks, effectively doubling the operable life before replacement may be performed. This feature also provides the utility of alternative materials such as those outlined above.

In some implementation, as illustrated in FIG. 14A, and FIGS. 15A and 15B, respective bearing blocks 1460 can be configured (e.g., shaped and/or sized) to receive and operably house a bushing 1472 that is disposed between the bearing block 1460 and the respective shafts 1402, 1434, 1436. As an example, a busing 1472 can be disposed in the top passage 1462 and the bottom passage 1464 of the bearing block 1460. In this implementation, for example, the bushing 1472 can act as a replaceable wear component that remains stationary while the shaft rotates within.

Further, as illustrated in FIGS. 14-15, the bearing block 1460 can comprise a top edge 1474 and a bottom edge 1476 that respectively abut the gear casing block 1416. That is, for example, because the distance between the top edge 1474 and the edge of the top passage 1462 (e.g., a bottom edge 1476 and bottom passage 1464) is greater than the height of the gears 1408 (e.g., or 1410) from the driver shaft 1402 (e.g., or driven shaft 1434, 1436), the gear casing block 1416 (e.g., or 1420) provides a stop for the bearing block 1460 in the direction of the gears 1408 (e.g., or 1410). In this way, for example, a biasing force in the direction of the gears 1408, 1410 provided by the gasket (e.g., O-ring) 1470*b* stops the bearing block 1460 from pressing against the gears 1408, 1410, for example, thereby mitigating wear of the gears against the bearing block 1460. As an example, a gap of desired tolerance can be provided between the gears 1408, 1410 and the bearing block 1460, based on the location (e.g., width) of the gear casing clock 1416, 1420.

FIGS. 14A-15B, the bearing blocks 1460 (e.g., and the bushings 1472) may operably support the driver shaft and the driven shafts. That is, for example, the bearing blocks 1460 (e.g., and the bushings 1472) can provide stability to the shafts during rotation, such as to mitigate oscillation outside of the axis of rotation of the shafts. Further, for example, if the bearing blocks 1460 and or bushing 1472 become worn or damaged, the bearing blocks and/or the bushings can be removed from the housing and replaced to restore the shaft support within desired operation specification, and restore pump efficiency. As another example, the faces of the bearing blocks 1460 (e.g., facing the gears 1408, 1410) may also function in the same manner as the end plates described above. That is, they may act as replaceable wear component, which, if worn or damaged, can be swapped or replaced to restore the performance of the pump.

Figure 16A:
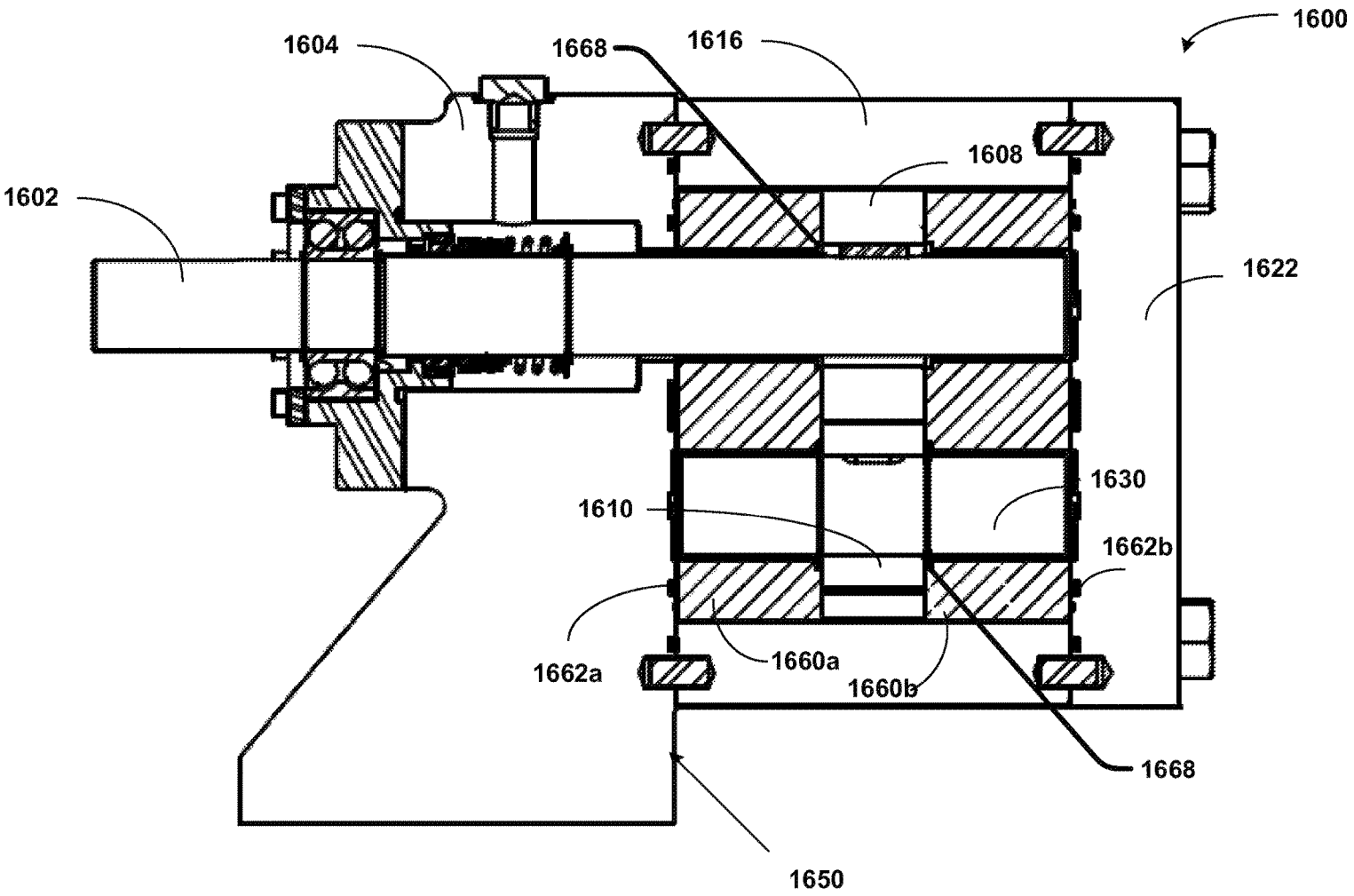
FIGS. 16A, 16B, and 16C are component diagrams illustrating various views of yet another implementation of an example external gear pump.
Figure 16B:
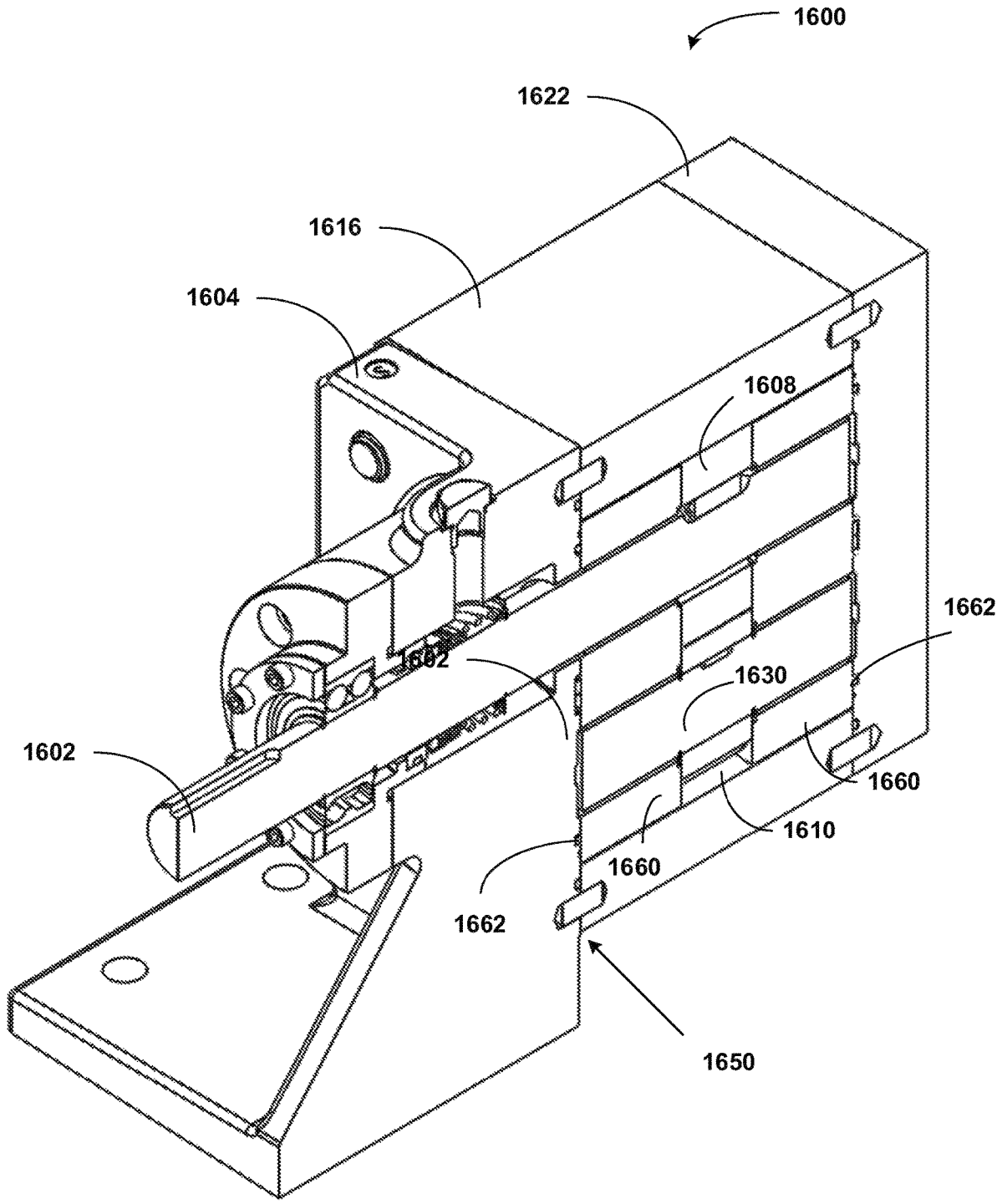
Figure 16C:
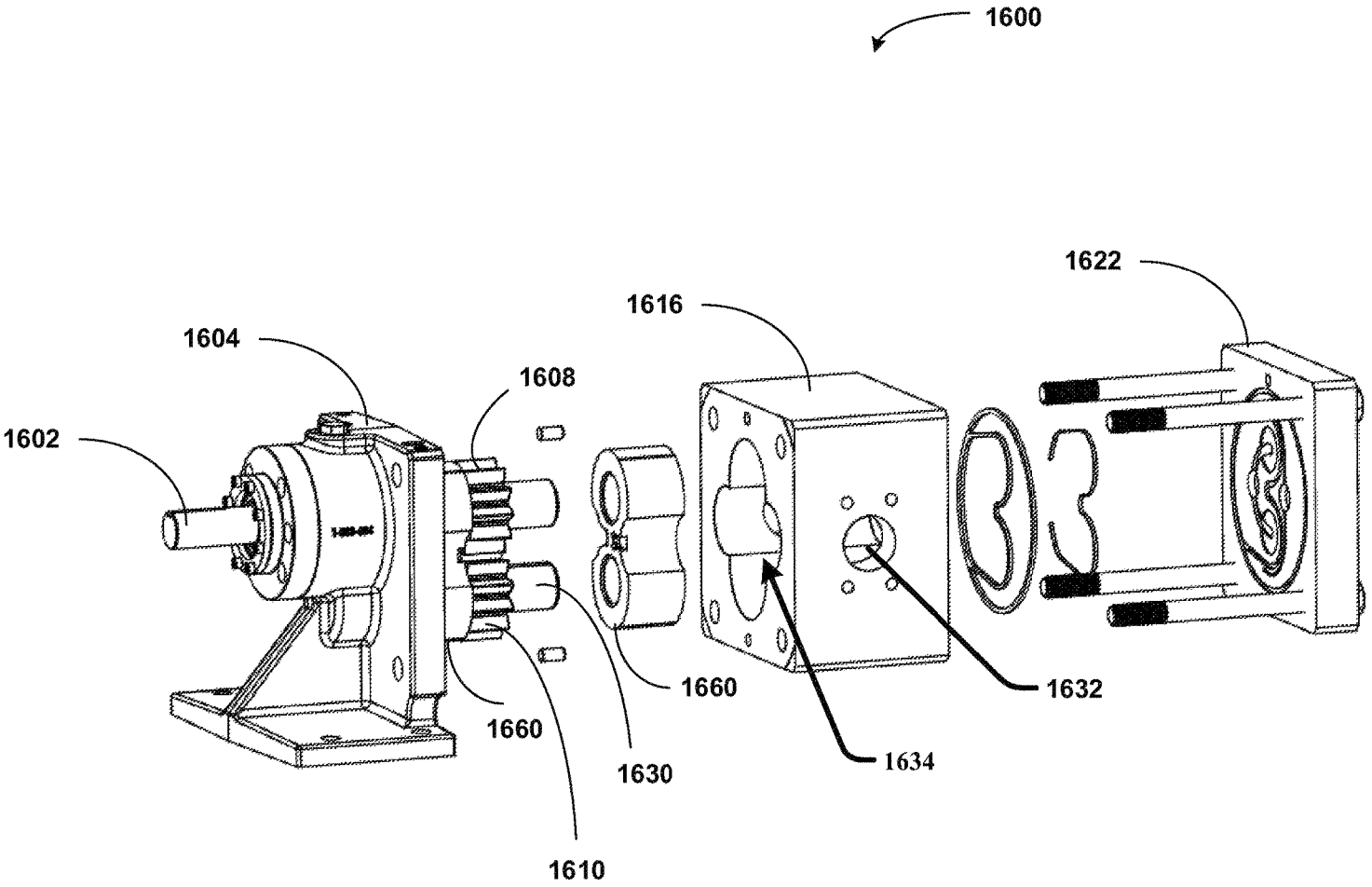

FIGS. 16A, 16B, and 16C illustrate yet another embodiment of an innovative external gear pump 1600. FIG. 16A shows a sectional view of external gear pump 1600, while FIG. 16B shows an isometric view of the external gear pump 1600. FIG. 16C shows an exploded isometric view of external gear pump 1600. In this implementation, external gear pump 1600 comprises a single gear pair combination. Alternatively, gear pair combinations with two, three, or more gear pair combinations may also be used.

As illustrated in FIGS. 16A, 16B, and 16C, external gear pump 1600 comprises a driver gear 1608 and a driven gear 1610. Driver gear 1608 is operably, fixedly engaged with a driver shaft 1602. Driven gear 1610 is operably, fixedly engaged with a driven shaft 1630. In this example, bracket 1604, gear casing 1616, and casing head 1622 form the housing 1650 of external gear pump 1600. Further, an inlet/outlet port 1632 (e.g., depending on the direction of rotation of the driver shaft 1602). The port 1632 is fluidly coupled with a pumping chamber 1634, in which the respective gears 1608, 1610 are operably disposed, to pump fluid to/from the port 1632.

External gear pump 1600 can comprise at least one replaceable pressure balanced bearing block 1660. The pressure balanced bearing block 1660 may be constructed with or coated with abrasive resistant material that extends the life of the external gear pump 1600. Such material can also reduce the friction between surfaces and improve the life of the external gear pump under poor feeding conditions.

For example, pressure balanced bearing blocks 1660 may be constructed or coated with Through Hardened 4140 Steel; Austenized 4140 Steel; Diamond Like Coating 4140 Steel; Electroless Nickel Plated 4140 Steel; Ti/AL nitrided 4140 Steel; Marquenched 25100 Steel; Ductile Iron; Austempered Ductile Iron; Anodized Aluminum with PTFE; Tungsten Carbide; Duplex Stainless Steel; Chrome White Cast Iron; Electroless Nickel Plated Ductile Iron; Armoloy XADC or TDC Coated Ductile Iron; Diamond-Like Carbon (DLC) Coated Ductile Iron; Diamond-Like Carbon (DLC) Coated gray iron DU (PTFE-Impregnated Bronze with Steel Reinforcement); Silicon Carbide; Anodized Aluminum with PTFE; and VESPEL®. In addition, bushings 1460 may be made up of a combination of these materials to extend the life of the pump before repair or replacement. A TEFLON® coating may also be used in conjunction with these materials.

Figure 17:
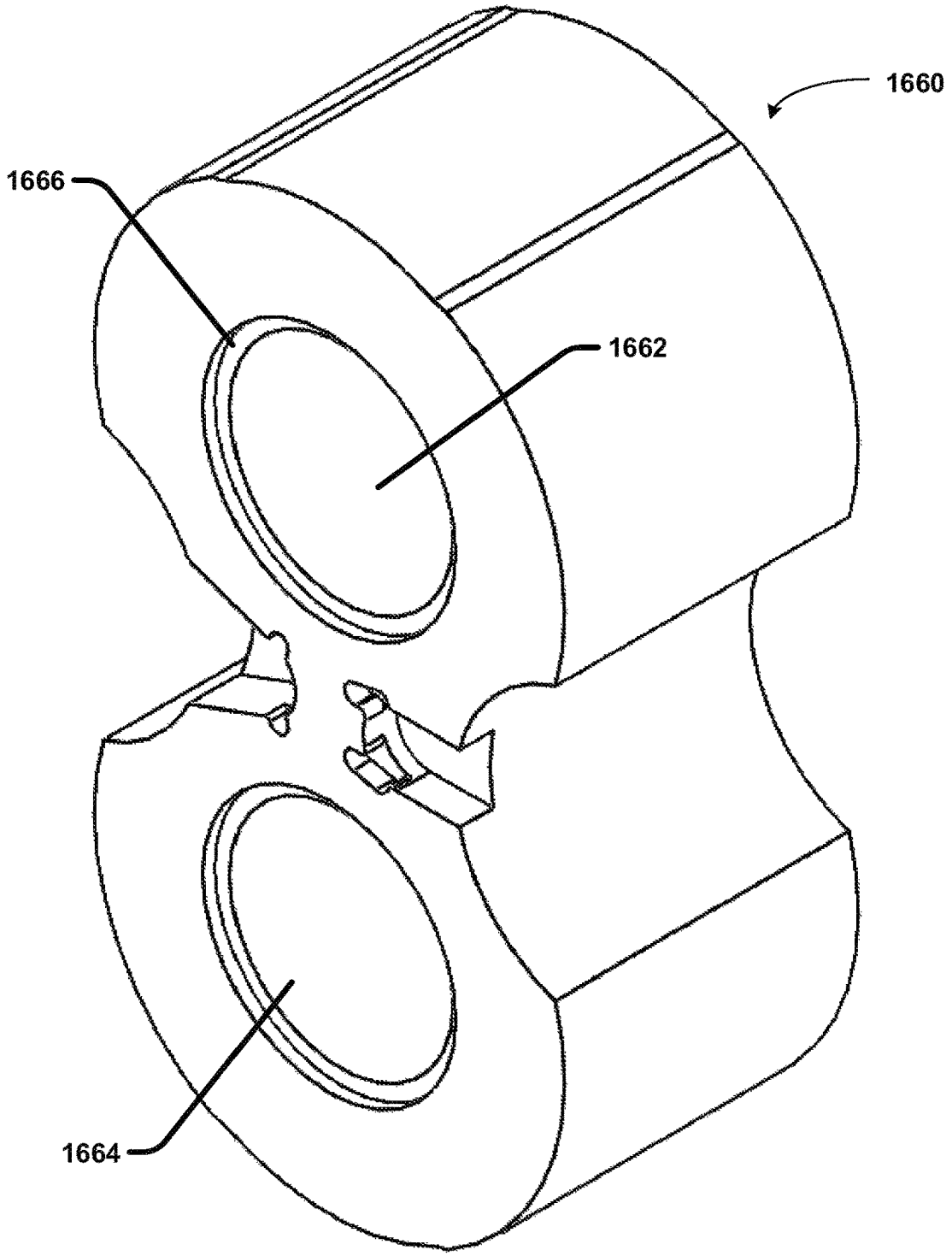
FIG. 17 is a component diagram illustrating an implementation of an example pressure balanced bearing block that may be used in an external gear pump.
Figure 18A:
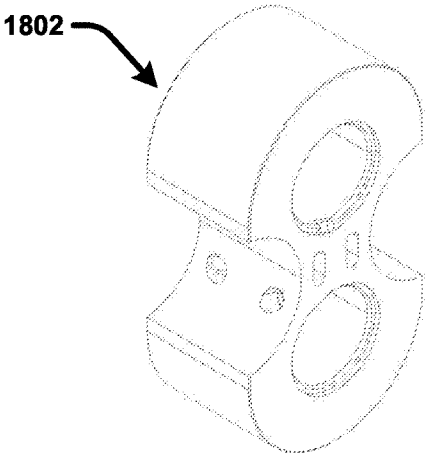
FIGS. 18*a*, 18*b*, 18*c*, 18*d* and 18*f* are component diagrams illustrating various views of yet another implementation of bearing/bushing blocks.
Figure 18B:
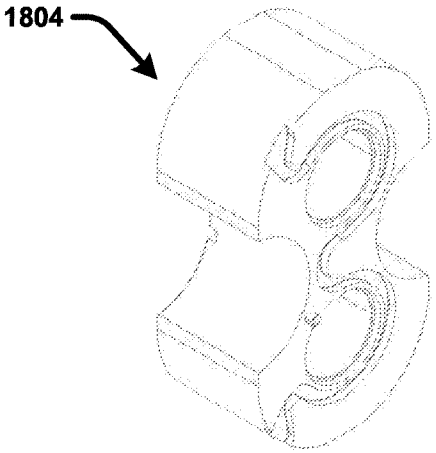
Figure 18C:
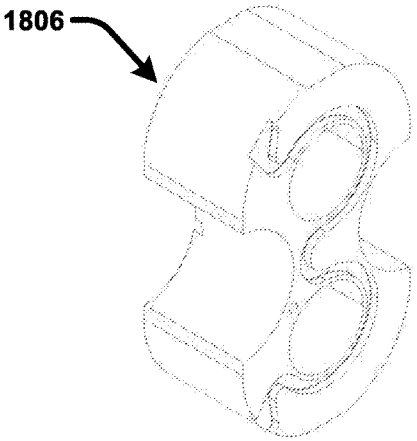
Figure 18D:
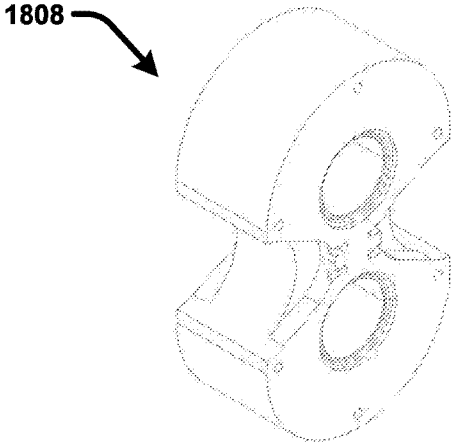
Figure 18E:
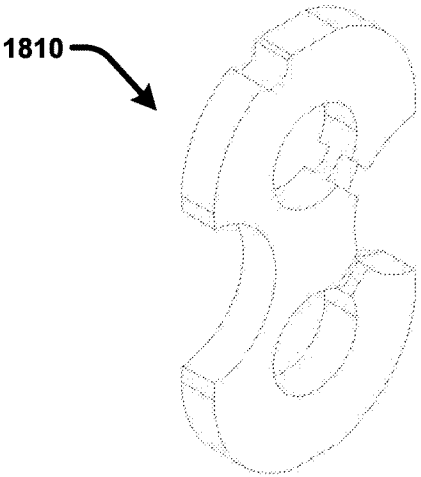
Figure 18F:
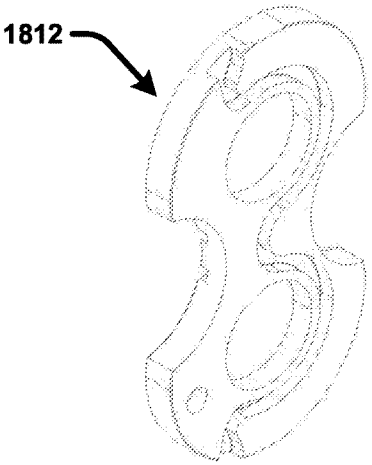

FIG. 17 illustrates a component perspective view of an example pressure balanced bearing block 1660. With continued reference to FIGS. 16A, 16B, and 16C, in this example, the bearing block 1660 comprises a top passage 1662 and a bottom passage 1664. For example, the top passage 1662 can be configured to receive the driver shaft 1602, and the bottom passage 1664 can be configured to receive a driven shaft 1630. Further, the bearing block 1660 can comprise a recess, shoulder or annular shaped step 1666 proximate the opening of respective passages 1662, 1664. In one implementation, the recess 1666 can comprise a groove that is configured to receive, and operably hold, a gasket 1668 (e.g., O-ring). The gasket 1668, for example, may be used to mitigate fluid and pressure slipping internally back from the high pressure discharge side of the pump to the low pressure suction side of the pump, to maintain performance.

As can be seen from FIGS. 16A, 16B, and 16C, pressure balanced bearing blocks 1660 may be arranged on either side of driver gear 1608 and driven gear 1610. That is, for example, the driver gear 1608 and the driven gear 1610 may be sandwiched between left 1660*a* and right 1660*b* pressure balanced bearing blocks when operably held together within the housing 1650.

In some implementations, the pressure balanced bearing blocks 1660 can be configured for easy insertion into and removal from the housing 1650 of the external gear pump

1600. For example, the bracket 1604, gear casing block 1616, and casing head 1622 can be separated from each other, and the bearing blocks 1660 may be removed and replaced.

In one implementation, gaskets 1662*a* and 1662*b* (e.g., O-rings) can be disposed in the gear pump 1600, at the bracket 1604 and casing head 1622 respectively. In this implementation, respective O-rings 1662 may also be utilized as seals against each bearing block 1660 (e.g., on the left side of the left block 1660*a* and right side of the right pressure balanced bearing block 1660*b*). That is, for example, pressure balanced bearing block 1660 and gaskets 1662 can mitigate leakage of process fluid from the pumping chamber 1634, providing a seal for the housing for sealing internal liquid to the exterior of the external gear pump 1600. Further, pressure balanced bearing blocks 1660 may also operably provide support to the respective shafts 1602 1630, to mitigate oscillation of the shafts outside of their respective axes of rotation. Additionally, the bearing blocks 1460 may provide protection to the driver shaft 1602 and driven shafts 1630.

That is, in some implementations, the pressure balanced bearing blocks 1660 may act as a replaceable wear component that can help maintain tight clearances in the pumping chamber 1634 by the means of hydraulic pressure balancing. That is, for example, the gaskets 1662 can provide a biasing force that biases the left bearing block 1660*a* in a right direction against the gears 1608, 1610, and the right bearing block 1660*b* in a left direction toward the gears 1608, 1610. As an example. As an example, the pressure balanced bearing block 1660 wears can be biased against the gears 1608, 1610 to provide the tight clearance, and provide for greater pumping efficiency and higher pumping pressures. The pressure acting on the pressure balanced bearing block 1660 may maintain the desired end clearance between the gears and the pressure balanced bearing block 1660.

Additionally, in some implementation, as illustrated respective bearing blocks 1660 can be configured (e.g., shaped and/or sized) to receive and operably house a bushing that is disposed between the bearing block 1660 and the respective shafts 1602, 1630. As an example, a bushing can be disposed in the top passage 1662 and the bottom passage 1664 of the bearing block 1660. In this implementation, for example, the bushing can act as a replaceable wear component that remains stationary while the shaft rotates within.

In some implementations, the bearing blocks 1660 (e.g., and the bushings) may operably support the driver shaft and the driven shafts. That is, for example, the bearing blocks 1660 (e.g., and the bushings) can provide stability to the shafts during rotation, such as to mitigate oscillation outside of the axis of rotation of the shafts. Further, for example, if the bearing blocks 1660 and/or bushing become worn or damaged, the bearing blocks and/or the bushings can be removed from the housing and replaced to restore the shaft support within desired operation specification, and restore pump efficiency. As another example, the faces of the bearing blocks 1660 may also function in the same manner as the end plates described above. That is, they may act as replaceable wear component, which, if worn or damaged, can be swapped or replaced to restore the performance of the pump.

Alternate implementations are anticipated. For example, FIGS. 18*a*-18*f* are component diagrams illustrating alternate embodiments of example bearing blocks that may be implemented in one or more of the pump systems described herein. As illustrated, bearing blocks 1802, 1804, 1806, 1808 may be utilized in example pump system 1600, or other similar pump systems. Example bearing blocks 1810, 1812 may be utilized in example pump system 1200, or other similar pump systems.

Figure 19A:
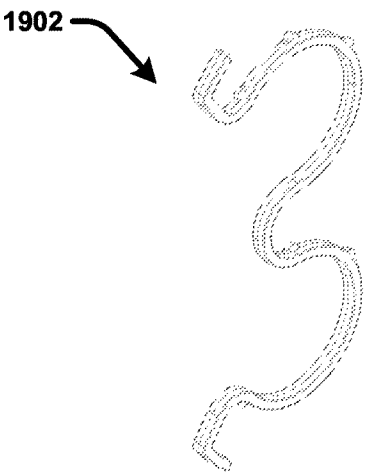
FIGS. 19*a*, 19*b*, 19*c*, and 19*d* are component diagrams illustrating various views of one or more components that may be implemented in one or more of the pumps described herein.
Figure 19B:
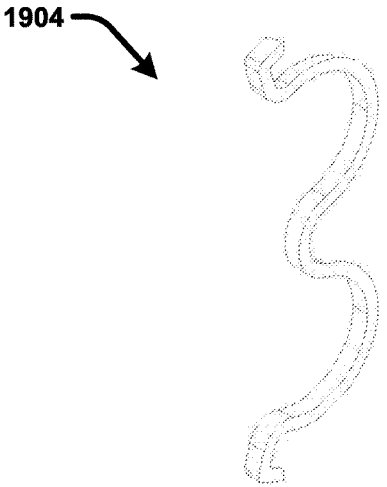
Figure 19C:
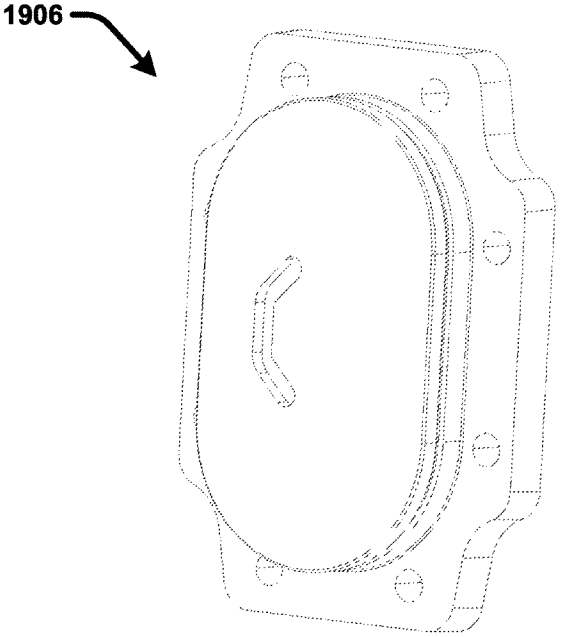
Figure 19D:
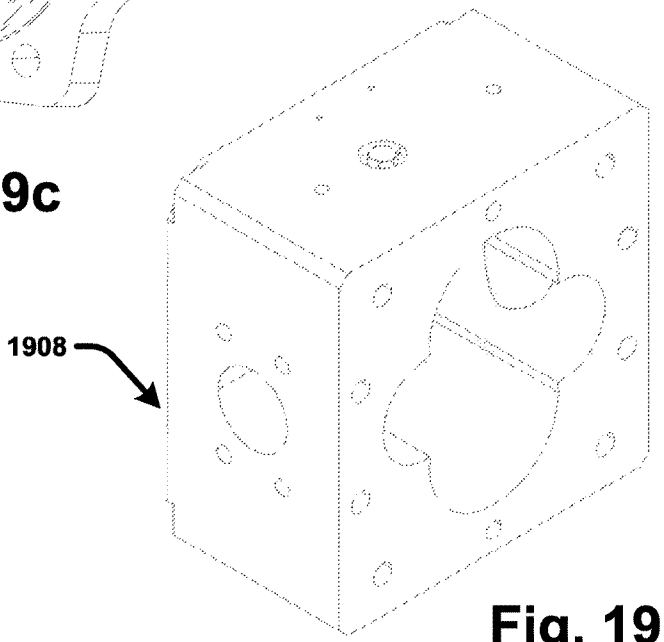

With continued reference to FIGS. 16A-16C, FIGS. 19*a*-19*d* are component diagrams illustrating alternate embodiments of example portions of exemplary pump systems described herein. For example, FIGS. 19*a* and 19*b* are example alternate implementations of a bushing gasket 1902, 1904 that may be used to mitigate leakage of fluid from a bearing block in the housing of a pump. As an example, the bushing gaskets may be used in similar ways as the gaskets 1662 found in example pump 1600 in FIG. 16C. Further, in FIG. 19*c*, an example alternate rear housing plate 1906 may be used in similar implementations as in pump 1600, or other similar pumps. Additionally, in FIG. 19*d*, an example gear casing 1908 may be used in similar pumps as found in 1600, or other similar cartridge style pumps.

Figure 20B:
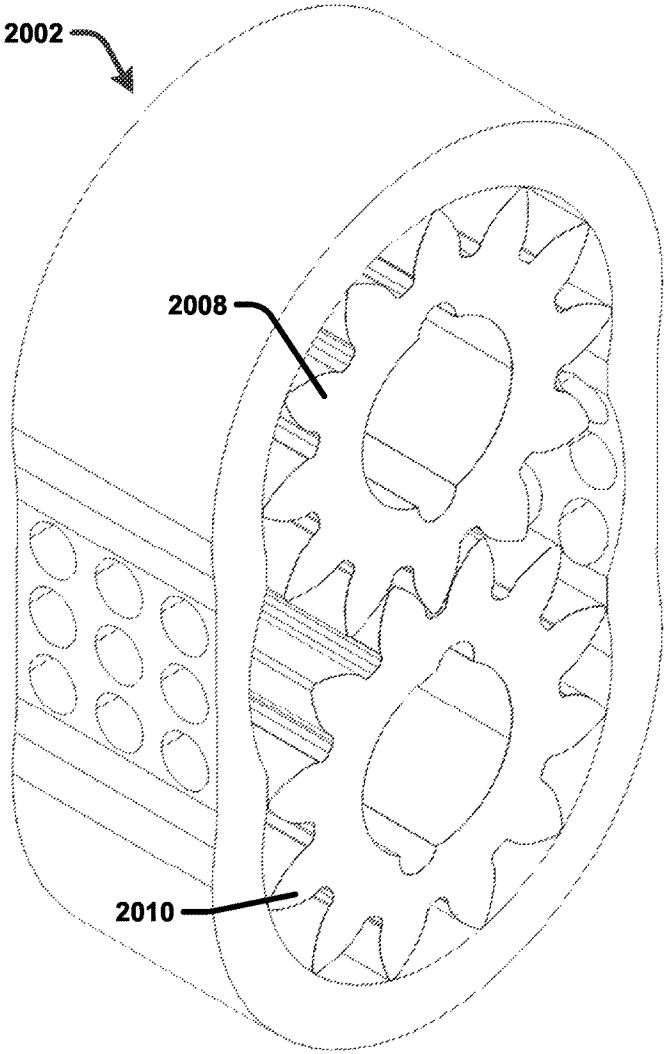
FIGS. 20*a*, and 20*b* are component diagrams illustrating various views of one or more components that may be implemented in one or more of the pumps described herein.
Figure 20A:
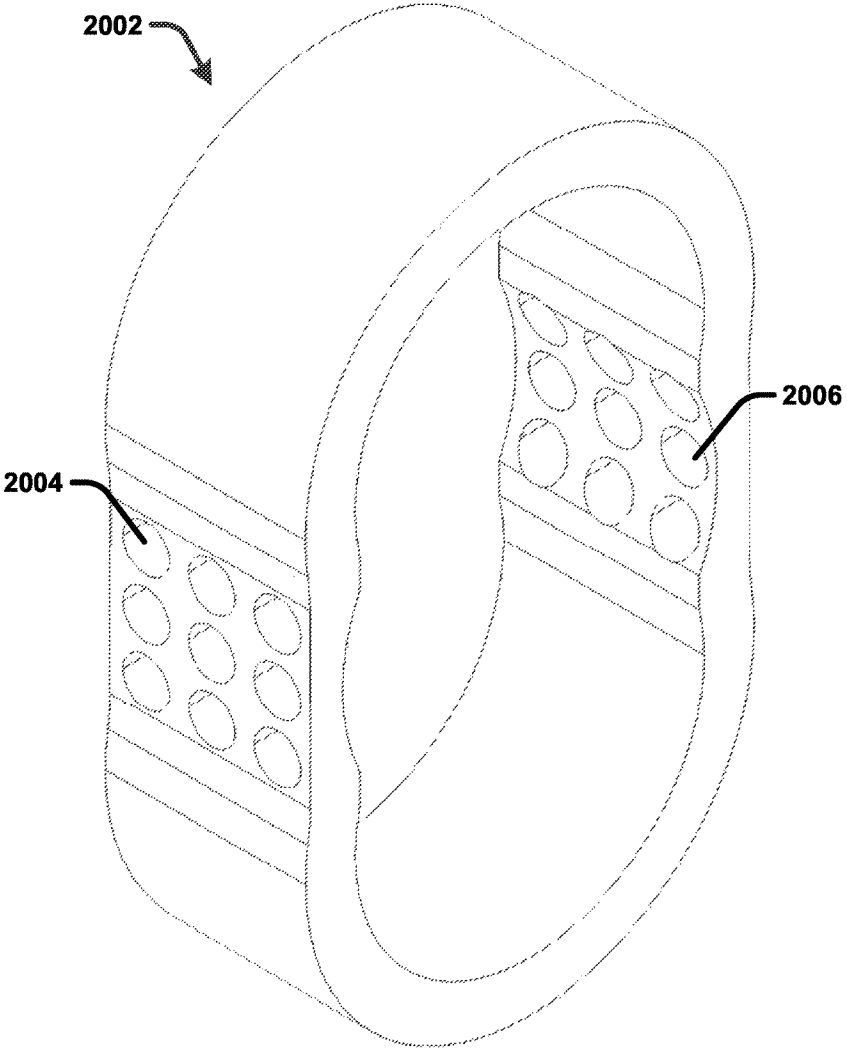

In one implementation, a cartridge pump may build upon the implementations described above and may include a combination of end plates and/or bearing blocks made of abrasive resistant material that acts as a wear surface. The cartridge pump also may add a casing liner between the outside of the gears and the inside of the housing. As an example, FIGS. 20*a* and 20*b* illustrate example implementations of a casing liner 2002. In this example, the casing liner 2002 may comprise vias 2004, 2006 at the intake and out let sides. As illustrated in FIG. 20*b*, the casing liner can house the gears 2008, 2010, and may comprise a wear component that can be merely replaced instead of replacing a portion of the housing.

As illustrated above, the casing liner 2002, and gear casings 1616, 1908 are components that may be separate from the housing of the pump and able to be replaced to restore pump performance. In this implementation, an internal cartridge could be removed and replaced with minimal disturbance of the housing, possibly allowing the housing to remain in place rather than removing from the installation. That is, for example, the housing of such a pump may be engaged with existing site plumbing, and fixed to a site platform. In this example, instead of removing the pump housing from the platform and plumbing to perform maintenance, merely the replaceable cartridge portion of the pump can be removed and replaced, in place.

In one implementation, the casing head of such a cartridge pump can comprise an access portion, which provides access to the replaceable portion of the gear pump. That is, for example, a replaceable cartridge for a gear pump can comprise one or more portions of the casing head, gear casing, casing liner, bearing blocks, gaskets, wear plates, and gears. In implementation, for example, the access portion of the casing head can be comprise fasteners that may be unfastened to access the cartridge. In this example, the cartridge can be uncoupled from the one or more shafts, and a new cartridge can be replaced and coupled with the shaft, and refastened to the casing head of the pump.

The end plate, bearing block, and cartridge pump implementations described above offer considerable advantages over conventional external gear pumps. For example, conventional external gear pumps may have an effective operable lifetime of one or two months, thereby needing to be replaced, particularly in an environment with abrasive material (e.g., "fracking"). The aforementioned implementations may offer the ability to lengthen the lifetime until replacement up to three years or more.

Further, the aforementioned implementations are more desirable over the conventional approach because it is a repairable option for the pump. Currently the conventional external gear pump is designed with large housing components that act as the wear components as well as house the bearings. For example, a conventional external gear pump may simply include a coating of heat-treated ductile iron with a depth of ½ a thousandth of an inch. Sand or other abrasives penetrate this shell extremely quickly. In addition, once the bearings are damaged or the wear on the face of the part from abrasion and contact from the gear the entire housing and bearings need to be replaced. The end plate, bearing block, and cartridge pump designs described above offer a much less costly alternative.

In addition, the materials used in the described implementations may add life to the pump by using abrasive resistant materials to coat the gears and use for wear components. For example, in all of the previously described implementations, gears, bushings, and/or shafts may also be constructed from or coated by an abrasive resistant material that extends the life of the pump. Gear coatings will also reduce the friction between surfaces and improve the life of the pump under poor feeding conditions. For example, gears may constructed or coated with Armoloy XADC or TDC Coated Steel, or Diamond-Like Carbon (DLC) Coated Steel; shafts may be constructed or coated with Nitralloy, or Tungsten Carbide Coated Steel; and, bushings may be constructed or coated with DU (PTFE-Impregnated Bronze with Steel Reinforcement), Silicon Carbide, Anodized Aluminum with PTFE, or VESPEL®.

Such abrasive resistant materials used in the external gear pumps may increase the life of the pump and result in less warranty claims. End users in the pipeline injection industry have desired reparability of wear components lacking in the conventional external gear pumps. A pump that allows several repairs before a new pump is needed is highly advantageous to end users. Such advantageous features as described above are becoming increasingly important as some environments are using higher concentrations of sand in their fracking process. The novel implantations described herein allow an external gear pump that may extend to applications where more abrasive material is present and the end users do not or cannot use filtration to remove the abrasives. In an example, the above-mentioned end plates and bearing blocks may be available in a repair kit separate from the external gear pump.

Figure 21:
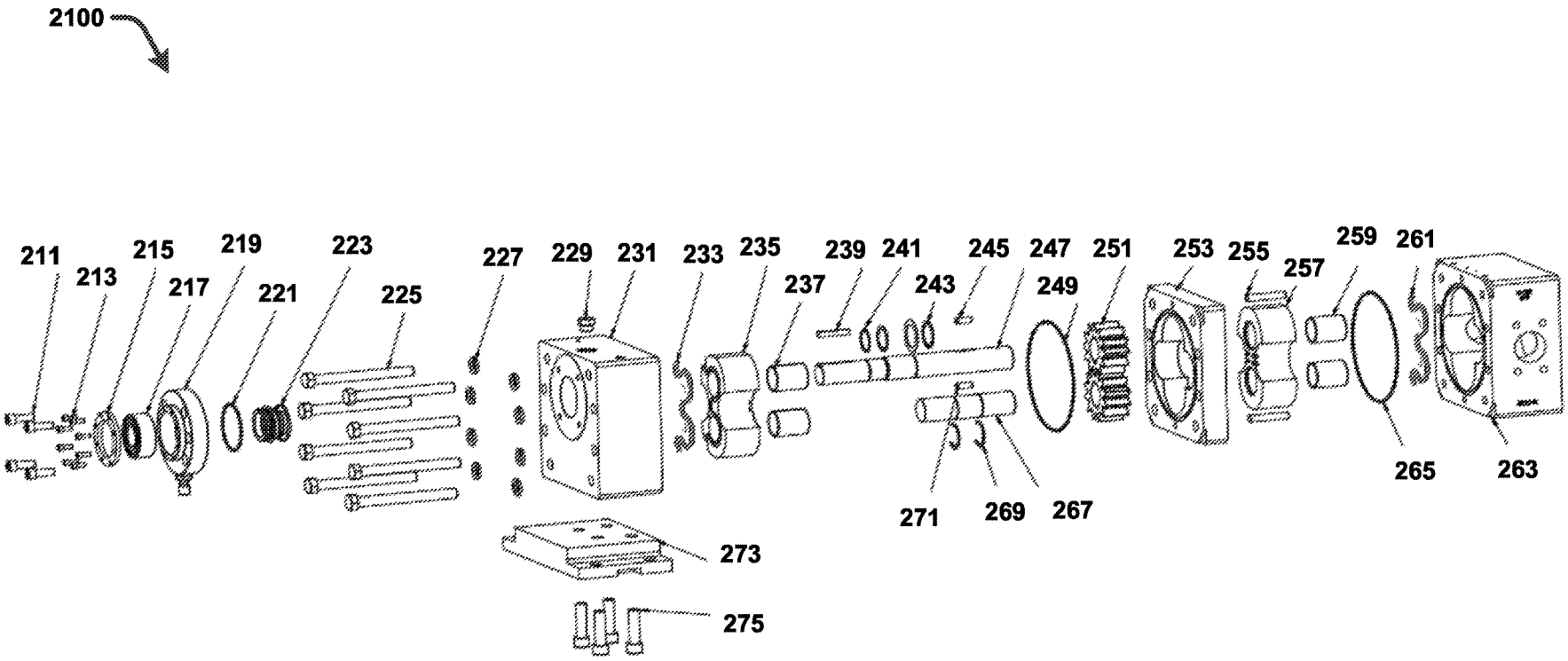
FIG. 21 is a component diagram illustrating an implementation of an example kit that may be used in an external gear pump.

In this aspect, one or more part kits may be devised and used to replace one or more portions a pump, for example, that are typically subjected to excessive wear during use, or for other maintenance purposes. As an illustrative example, FIG. 21*a* is a component diagram illustrating one example of one or more portions of a kit 2100 that may be utilized in one or more pumps described herein. In this example, one or more replacement parts can include a bracket 231, bracket foot 273, cap screws 275, a seal holder 219, bearing end cap 215, and head ports 263 (e.g., 2" SAE). Further, an example kit, such as a seal repair kit, may comprise a bearing 217 (e.g., a double row ball bearing), a set of retaining rings 243, 269, a seal holder O-ring 221, 261 a mechanical seal 223 (e.g., FKM/Sil-Cab), one or more seal washers (not listed), one or more retaining rings 243, 269, one or more beveled retaining rings 241, and one or more cap screws 211, 213, amongst other things.

As another example, a kit for a shaft replacement and/or repair may include a driver shaft 247, a driven shaft 267, and a shaft key 239, amongst other things. Additionally, for example, a kit for repair/replacement of a section may comprise one or more bushing assemblies 235, 237, 257, 259 (e.g., or fixed end plate assemblies, as in FIGS. 13A-C) one or more bushing gaskets 233, a casing and gear set 253, 251, one or more section O-rings 249, 265, and one or more dowel pins 255, 245, amongst other things. As another example, a complete rebuild or repair kit may include all of the items described above for the seal, shaft and section kits, in this aspect, along with one or more of caps screws 225, and lock washers 227, a fill port plug 229.

It is anticipated that one or more additional repair/replacement kits may be devised for various pumps, such as those with alternate arrangements, and/or additional sections. Further, alternate kits may comprise one or more of the components described herein, which may be configured for replacement, and comprise parts that are typically subjected to excessive wear.

The word "exemplary" is used herein to mean serving as an example, instance or illustration. Any aspect or design described herein as "exemplary" is not necessarily to be construed as advantageous over other aspects or designs. Rather, use of the word exemplary is intended to present concepts in a concrete fashion. As used in this application, the term "or" is intended to mean an inclusive "or" rather than an exclusive "or." That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. Further, at least one of A and B and/or the like generally means A or B or both A and B. In addition, the articles "a" and "an" as used in this application and the appended claims may generally be construed to mean "one or more" unless specified otherwise or clear from context to be directed to a singular form.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

Also, although the disclosure has been shown and described with respect to one or more implementations, equivalent alterations and modifications will occur to others skilled in the art based upon a reading and understanding of this specification and the annexed drawings. The disclosure includes all such modifications and alterations and is limited only by the scope of the following claims. In particular regard to the various functions performed by the above described components (e.g., elements, resources, etc.), the terms used to describe such components are intended to correspond, unless otherwise indicated, to any component which performs the specified function of the described component (e.g., that is functionally equivalent), even though not structurally equivalent to the disclosed structure which performs the function in the herein illustrated exemplary implementations of the disclosure. In addition, while a particular feature of the disclosure may have been disclosed with respect to only one of several implementations, such feature may be combined with one or more other features of the other implementations as may be desired and advantageous for any given or particular application. Furthermore, to the extent that the terms "includes," "having," "has," "with," or variants thereof are used in either the detailed description or the claims, such terms are intended to be inclusive in a manner similar to the term "comprising."

The implementations have been described, hereinabove. It will be apparent to those skilled in the art that the above methods and apparatuses may incorporate changes and modifications without departing from the general scope of this invention. It is intended to include all such modifications and alterations in so far as they come within the scope of the appended claims or the equivalents thereof.

What is claimed is:

1. A pump for use in a high pressure pipeline, comprising:

a pump bracket comprising a drive shaft cavity disposed along a longitudinal axis through the pump bracket;

a first gear casing selectably, fixedly engaged with the bracket, the first gear casing comprising a first gear chamber:

a driver shaft operably disposed in the drive shaft cavity, the driver shaft operably engaged at a proximal end of the pump with a motor that provides rotation to the driver shaft;

a first driver gear selectably, fixedly engaged with the driver shaft, the first driver gear disposed in the first gear chamber;

a first driven gear, the first driven gear meshedly engaged with the first driver gear, the first driven gear selectably, fixedly engaged with a first driven shaft in the first gear chamber, such that the rotation of the first driver gear results in fluid being drawn into the first gear chamber on a first side, and discharged from the first gear chamber on a second side;

a first bearing block, the first bearing block selectably disposed in the first gear casing between either the pump bracket and the first gear chamber, or the first gear chamber and the casing head, the first bearing block comprising a first driver shaft bearing that operably supports the driver shaft, and a first driven shaft bearing that operably supports the first driven shaft, the first bearing block comprising a gasket channel disposed on a face of the first bearing block that operably faces the first gear chamber to operably hold a gasket between the first bearing block and the first gear casing; and a casing head disposed at a distal end of the pump, the casing head selectably, fixedly engaged with the first gear casing and pump bracket, the casing head comprising a driver shaft end cavity to operably hold the driver shaft, the driver shaft end cavity closed at the distal end inside the casing head.

2. The pump of claim 1, comprising a first fixed end plate selectably disposed in the first gear casing between either the pump bracket and the first gear chamber, or the first gear chamber and the casing head.

3. The pump of claim 2, comprising a second fixed end plate selectably disposed in the first gear casing between either the pump bracket and the first gear chamber, or the first gear chamber and the casing head.

4. The pump of claim 3, comprising one or more of:

a first gasket channel disposed on a face of the first fixed end plate that is facing the first gear chamber, and a second gasket channel disposed on a face of the second fixed end plate that is facing the first gear chamber, the first and second gasket channels operably holding a gasket; and a third gasket channel disposed on a face of the first fixed end plate that is facing away from the first gear chamber, and a fourth gasket channel disposed on a face of the second fixed end plate that is facing away from the first gear chamber, the third and fourth gasket channels operably holding a gasket.

5. The pump of claim 3, comprising a first port disposed on the first side and a second port disposed on the second side, the respective ports fluidly coupled with the first gear chamber, wherein the first fixed end plate and the second fixed end plate respectively comprise a left passage and a right passage, the left passage fluidly coupled with the first port and the right passage fluidly coupled with the second port.

6. The pump of claim 3, wherein the first fixed end plate and the second fixed end plate are selectably interchangeable with each other.

7. The pump of claim 2, comprising:

a second gear casing selectably disposed distally from the first gear casing, the second gear casing comprising a second gear chamber;

a first separator plate selectably engaged with and disposed between the first gear casing and the second gear casing;

a second driver gear and second driven gear respectively disposed in the second gear chamber, such that rotation of the second driver gear results in fluid being drawn into the second gear chamber on the first side, and discharged from the second gear chamber on the second side; and a third fixed end plate selectably disposed in the second gear casing between either the first separator plate and the second gear chamber, or the second gear chamber and the casing head.

8. The pump of claim 7, comprising a fourth fixed end plate selectably disposed in the second gear casing between either first separator plate and the second gear chamber, or the second gear chamber and the casing head.

9. The pump of claim 7, comprising:

a first port disposed on the first side, the first port fluidly coupled with the first gear chamber and the second gear chamber on the first side; and a second port disposed on the second side, the second port fluidly coupled with the first gear chamber and the second gear chamber on the second side.

10. The pump of claim 1, comprising a second bearing block, the second bearing block selectably disposed in the first gear casing between either the pump bracket and the first gear chamber, or the first gear chamber and the casing head, the second bearing block comprising a second driver shaft bearing that operably supports the driver shaft, and a second driven shaft bearing that operably supports the driven shaft.

11. The pump of claim 10, wherein the first bearing block and the second bearing block are selectably interchangeable with each other.

12. A pump kit for use with a high pressure pump in a high pressure pipeline, wherein the high pressure pump comprises a pump bracket comprising a drive shaft cavity disposed along a longitudinal axis through the bracket, a first gear casing selectably, fixedly engaged with the bracket, the first gear casing comprising a first gear chamber, a driver shaft operably disposed in the drive shaft cavity, the driver shaft operably engaged at a proximal end of the pump with a motor that provides rotation to the driver shaft, a first driver gear selectably, fixedly engaged with the driver shaft, the first driver gear disposed in the first gear chamber, a first driven gear, the first driven gear meshedly engaged with the first driver gear, the first driven gear selectably, fixedly engaged with a first driven shaft in the first gear chamber, such that the rotation of the first driver gear results in fluid being drawn into the first gear chamber on a first side, and discharged from the first gear chamber on a second side, and a casing head disposed at a distal end of the pump, the casing head selectably, fixedly engaged with the first gear casing and pump bracket, the casing head comprising a driver shaft end cavity to operably hold the first driver shaft, the driver shaft end cavity closed at the distal end inside the casing head, the pump kit comprising:

a first bearing block, the first bearing block selectably disposed in the first gear casing between either the pump bracket and the first gear chamber, or the first gear chamber and the casing head, the first bearing block comprising a first driver shaft bearing that operably supports the driver shaft, and a first driven shaft bearing that operably supports the first driven shaft, the first bearing block comprising a gasket channel disposed on a face of the first bearing block that operably faces the first gear chamber to operably hold a gasket between the first bearing block and the first gear casing.

13. The pump kit of claim 12, comprising one or more of:

a replacement driver shaft; and a replacement driven shaft.

14. The pump kit of claim 12, comprising a replacement first gear casing.

15. The pump kit of claim 12, comprising one or more of:

a replacement first driver gear; and a replacement first driven gear.

16. The pump kit of claim 12, comprising one of:

a first fixed end plate that is selectably disposed in the first gear casing between either the pump bracket and the first gear chamber, or the first gear chamber and the casing head;

a second fixed end plate that is selectably disposed in the first gear casing between either the pump bracket and the first gear chamber, or the first gear chamber and the casing head; and a second bearing block, the second bearing block selectably disposed in the first gear casing between either the pump bracket and the first gear chamber, or the first gear chamber and the casing head, the second bearing block comprising a second driver shaft bearing that operably supports the driver shaft, and a second driven shaft bearing that operably supports the driven shaft.

17. The pump kit of claim 12, comprising one or more of:

a front shaft bearing selectably disposed outside of a housing of the pump;

a set of one or more shaft retaining rings selectably disposed along one or more of the driver shaft, and the first driven shaft; and a shaft to pump housing mechanical seal selectably disposed between the driver shaft and the housing of the pump.

18. A cartridge pump for use in a high pressure pipeline, comprising:

a gear casing configured to be selectably, fixedly engaged with a pump bracket on a first side and with a pump casing head on a second side during operation, the gear casing comprising:

a gear chamber that operably holds a driver gear and a driven gear, the driver gear meshedly engaged with the driven gear, the driven gear selectably, fixedly engaged with a first driven shaft in a first gear chamber, and the driver gear selectably, fixedly engaged with a driver shaft, the driver shaft selectably engaged with a motor that provides rotation, such that when the driver shaft is rotated the driver gear rotates resulting in fluid being drawn into the gear chamber from a first port, and discharged from the gear chamber to a second port; and a first bearing block disposed on the first side of the gear casing and a second bearing block disposed on the second side of the gear casing, the respective bearing blocks comprising one or more bearings to operably support the driver shaft and the driven shaft;

wherein the first bearing block comprises a gasket channel disposed on a face of the first bearing block that operably faces the first gear chamber that operably holds a gasket between the first bearing block and the first gear casing;

wherein the gear casing is selectably replaceable with a replacement gear casing, the respective fixed end plates or the respective bearing blocks are selectably replaceable with a replacement fixed end plate or replacement bearing block, the first fixed end plate is selectably interchangeable in the pump with the second fixed end plate, and the first bearing block is selectably interchangeable in the pump with the second bearing block.

* * * * *